US010995468B2

(12) United States Patent
Millman

(10) Patent No.: US 10,995,468 B2
(45) Date of Patent: May 4, 2021

(54) COVER DEVICE

(71) Applicant: Steve Millman, Grand Rapids, MI (US)

(72) Inventor: Steve Millman, Grand Rapids, MI (US)

(73) Assignee: Steve Millman, Grand Rapids, MI (US)

( * ) Notice: Subject to any disclaimer, the term of this patent is extended or adjusted under 35 U.S.C. 154(b) by 408 days.

(21) Appl. No.: 16/106,803

(22) Filed: Aug. 21, 2018

(65) Prior Publication Data

US 2019/0153699 A1 May 23, 2019

Related U.S. Application Data

(60) Provisional application No. 62/588,694, filed on Nov. 20, 2017.

(51) Int. Cl.
*E02D 29/14* (2006.01)

(52) U.S. Cl.
CPC ..... *E02D 29/1427* (2013.01); *E02D 29/1445* (2013.01)

(58) Field of Classification Search
CPC ..... Y10T 292/0811; Y10T 292/0856; Y10T 292/1079; Y10T 292/307; Y10T 292/308; E05C 9/08; E05C 9/085; E05C 3/004; E05C 3/06; E05C 3/10; E02D 29/14; E02D 29/1427; E02D 29/1445
USPC ..... 404/25–26; 52/19–20; 49/463, 465; 70/163, 166–173; 292/DIG. 11
See application file for complete search history.

(56) References Cited

U.S. PATENT DOCUMENTS 822,562 A * 6/1906 Tucker
1,560,489 A * 11/1925 Yager ..... E05C 9/046 292/37
1,833,864 A * 11/1931 Adams ..... B60R 25/00 70/172
2,885,931 A * 5/1959 McDonald ..... B60B 7/16 70/167
RE26,366 E * 4/1968 Flegel
4,577,478 A * 3/1986 Economopoulos .. B65D 90/105 70/168
4,902,165 A * 2/1990 Embree ..... B65D 55/14 404/25
5,979,117 A 11/1999 Fuller
6,161,589 A 12/2000 Bolotte et al.
6,453,603 B1 9/2002 Baker
6,488,440 B1 12/2002 Hill
6,584,734 B2 7/2003 Mihalicz et al.
6,739,796 B1 * 5/2004 Del Nero ..... E02D 29/1427 404/25
7,469,502 B1 * 12/2008 Steel ..... E05C 9/06 49/463
7,704,010 B2 * 4/2010 Nolle ..... E02D 29/1427 404/25

(Continued)

*Primary Examiner* — Sunil Singh
(74) *Attorney, Agent, or Firm* — Price Heneveld LLP

(57) ABSTRACT

A cover device includes a cover plate having a body portion with inner and outer surfaces. A deployable retainer mechanism is positioned on the inner surface of the cover plate and includes a plurality of engagement features operable between retracted and deployed positions. An adjustment mechanism interconnects the deployable retainer mechanism and the cover plate, wherein the adjustment mechanism includes a portion thereof that is accessible from the outer surface of the cover plate for moving the plurality of engagement features between the retracted and deployed positions.

8 Claims, 15 Drawing Sheets

(56) References Cited

U.S. PATENT DOCUMENTS

| | | | | |
|---|---|---|---|---|
| 7,797,892 | B2 | 9/2010 | Cannistraro et al. | |
| 8,689,488 | B2 * | 4/2014 | Rodrigue | E01C 9/083 49/463 |
| 2002/0148260 | A1 * | 10/2002 | Garguilo | E02D 29/1427 70/168 |
| 2008/0075532 | A1 | 3/2008 | Boyd | |
| 2008/0256997 | A1 * | 10/2008 | Nolle | E05C 9/06 70/167 |
| 2008/0314902 | A1 | 12/2008 | Dayton et al. | |
| 2014/0041311 | A1 | 2/2014 | Auckland | |

* cited by examiner

COVER DEVICE

CROSS-REFERENCE TO RELATED APPLICATION

This application claims priority to and the benefit under 35 U.S.C. § 119(e) of U.S. Provisional Patent Application No. 62/588,694, filed on Nov. 20, 2017, entitled COVER DEVICE, the entire disclosure of which is hereby incorporated herein by reference.

FIELD

The present device generally relates to a cover device for covering open apertures, and more specifically, to a cover device having a cover plate and a deployable engagement member for selectively engaging the contours of an open aperture for securing the cover plate over an opening of the aperture.

BACKGROUND

In various construction projects, concrete is poured to define floors of a building. Such a construction project may include a number of floors comprised of concrete slab floor surfaces. Interconnecting utilities, such as plumbing, electrical and the like, between adjacent floors requires boring holes through the concrete. Such holes can be cut in concrete using any number of techniques, such as coring with a coring barrel. The resulting hole or aperture may be present in the concrete slab for periods of time during the construction project. Before utilities, pipes or other structures are positioned in the apertures, the open apertures must be covered in order to provide a safe and compliant jobsite. Presently known aperture covers are generally comprised of a flat wood piece (such as plywood) sufficiently sized to cover the hole, wherein a block of wood is generally fastened to an underside of the plywood and is received in the hole when the hole is covered by the plywood. Such a cover device is prone to movement as the block of wood fastened to the underside of the plywood does not consistently engage the contours of the hole, but rather is set in-place member used to keep the plywood from shifting laterally. Further, such covers devices can be a tripping hazard. Thus, a cover device that can be easily installed using engaging retention features is desired.

SUMMARY

In at least one aspect, a cover device includes a cover plate having a body portion with inner and outer surfaces. The inner and outer surfaces are interconnected by a surrounding side portion. A deployable retainer mechanism is positioned on the inner surface of the cover plate and includes a plurality of engagement features operable between retracted and deployed positions. An adjustment mechanism interconnects the deployable retainer mechanism and the cover plate, wherein the adjustment mechanism includes a portion thereof that is accessible from the outer surface of the cover plate for moving the plurality of engagement features between the retracted and deployed positions.

In at least another aspect, a cover device is configured to cover an aperture having an inner perimeter surface. The cover device includes a cover plate and a retainer mechanism operably coupled to the cover plate. The retainer mechanism includes one or more engagement features operable between retracted and deployed positions, wherein at least one of the one or more engagement features engages the inner perimeter surface of the aperture in the deployed position. An adjustment mechanism is operably coupled to the retainer mechanism and configured to move the one or more engagement features between the stowed and deployed positions.

In at least another aspect, a cover device is configured for use with an aperture disposed through a surface and having an inner perimeter surface. The cover device includes a cover plate having inner and outer surfaces and a retainer mechanism operably coupled to the inner surface of the cover plate. The retainer mechanism includes a plurality of engagement features operable between retracted and deployed positions, wherein at least one of the engagement features of the plurality of engagement features engages the inner perimeter surface of the aperture in the deployed position when the cover plate is positioned over the aperture. An adjustment mechanism is operably coupled to the one or more engagement features to move the one or more engagement features between the retracted and deployed positions, wherein the adjustment mechanism includes an engagement feature accessible from the outer surface of the cover plate.

In at least another aspect, a cover device includes a cover plate having inner and outer surfaces and an outer perimeter. A deployable retainer mechanism is positioned on the inner surface of the cover plate and includes a plurality of gears rotatably coupled to the inner surface of the cover plate. One or more of the gears includes an engagement feature outwardly extending from a body portion of the gear. The engagement feature is operable between retracted and deployed positions. An adjustment mechanism is accessible from the outer surface of the cover plate and includes a drive gear rotatably coupled to the inner surface of the cover plate. The drive gear interconnects the gears of the plurality of gears in a geared relationship, such that rotation of the drive gear in a first direction provides for rotation of the gears of the plurality of gears in a second direction that is opposite the first direction.

These and other features, advantages, and objects of the present device will be further understood and appreciated by those skilled in the art upon studying the following specification, claims, and appended drawings.

DETAILED DESCRIPTION OF EMBODIMENTS

Figure 1:
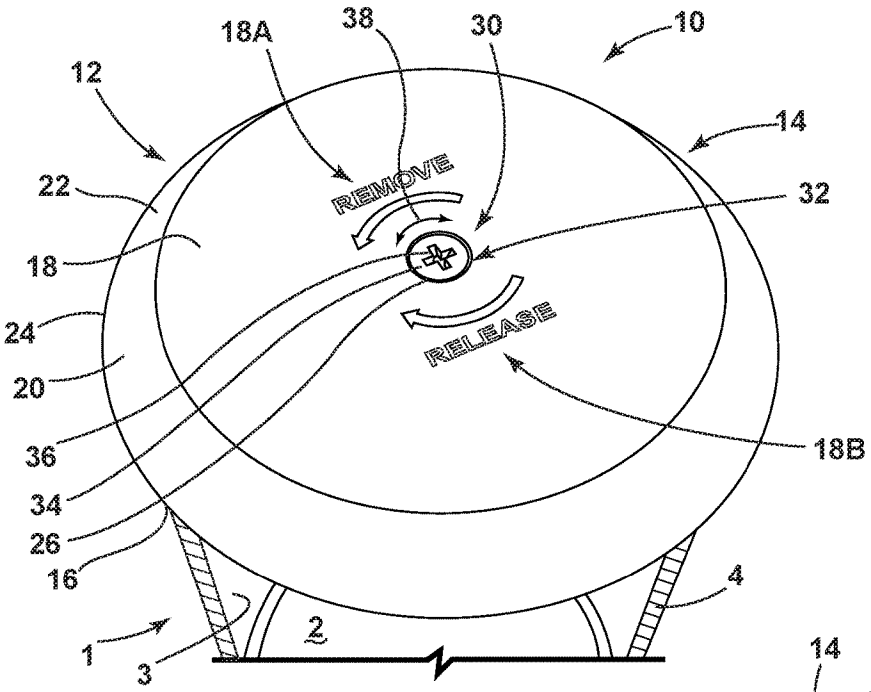
FIG. 1 is a top perspective view of a cover device positioned on a structure having an aperture.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates a cover device for covering an aperture 1. In the embodiment shown in FIG. 1, the aperture 1 includes a cavity or receiving well 2 having an inner perimeter surface 3. While the aperture 1 shown in FIG. 1 generally includes a sidewall 4, it is contemplated that the aperture 1 may be positioned through a concrete slab used as a floor (or other like support surface) in a construction project, wherein the receiving well or cavity 2 is disposed through the concrete slab. Thus, the aperture 1 as depicted in FIG. 1 is exemplary only, and the features which comprise the aperture 1 are exemplary of an aperture designed to be covered by the present cover device 10. The aperture 1 may have any shape, or could be a combination of numerous adjacent cored holes. The aperture 1 is shown in FIG. 1 as a round aperture. For purposes of this disclosure, the aperture 1 is illustrated as a round aperture, but is not meant to limit the scope of the present concept in any way.

As further shown in FIG. 1, the cover device 10 includes a cover plate 12 having a body portion 14 with inner and outer surfaces 16, 18 which are interconnected by a surrounding side portion 20. In the embodiment shown in FIG. 1, the inner and outer surfaces 16, 18 are interconnected by the side portion 20, which is disposed in a tapered relationship between the inner surface 16 and outer surface 18 to provide a beveled edge 22 surrounding the cover plate 12 along an outer perimeter 24 thereof. In the embodiment shown in FIG. 1, the cover plate 12 is a round cover plate positioned over a round aperture 1. However, it is contemplated that the cover plate 12 may include a variety of configurations necessary to cover the aperture 1. As explained above, the aperture 1 may include a round aperture or a combination of rounds apertures. Further, the aperture 1 may include any other shape configuration positioned through a support surface that needs to be covered. As such, the cover plate 12 may include a variety of configurations beyond the disk-shaped cover plate 12 shown in FIG. 1. For purposes of the present disclosure, the disk-shaped cover plate 12 will be described herein, however, other configurations (such as rectangles, squares and the like) are contemplated for use with the present concept without departing form the spirt of the present concept. Further, the cover plate 12 may be much greater in size as compared to the overall size of the aperture 1. The beveled edge 22 surrounds the side portion 20 of the cover plate 12, such that the cover device 10 is less of an obstruction when placed over an aperture on a floor surface as compared to a section of plywood having a blunt 90 degree edge. The beveled edge 22 also allows for easy clean up around a jobsite when sweeping a floor surface on which the cover device 10 is positioned. The cover plate 12 may include a color (such as a construction orange color) to provide a visible cautionary feature to workers on a jobsite.

As further shown in the embodiment of FIG. 1, the outer surface 18 of the cover plate 12 includes indicia 18A, 18B for guiding a user's interaction with an adjustment mechanism 30. The adjustment mechanism 30 is positioned in a generally central portion of the body portion 14 of the cover plate 12 and includes a fastener 32 having a head portion 34 with an engagement portion 36 disposed thereon. The fastener 32 is shown disposed within a receiving aperture 26 disposed through the body portion 14 of the cover plate 12 between the inner and outer surfaces 16, 18 thereof. In use, the engagement portion 36 of the fastener 32 is contemplated as to be engaged by a tool of a user (such as a screwdriver or drill) for rotating the fastener 32 within the receiving aperture 26 along a rotational path as indicated by arrow 38. Thus, the fastener 32 defines an engagement portion accessible from the outer surface 18 of the cover plate 12 for moving a plurality of engagement features 60 (FIG. 3) between retracted and deployed positions, as further described below. In the embodiment shown in FIG. 1 the indicia 18A, 18B respectively include the wording "REMOVE" and "RELEASE" positioned adjacent to respective directional arrows for providing a remove or release function of a retainer mechanism 50 (FIG. 2) using the adjustment mechanism 30. The body portion 14 of the cover plate 12 may be a solid body portion, or may be a body portion that is substantially hollow with a plurality of reinforcement ribs disposed on the inner surface 16 thereof.

Figure 2:
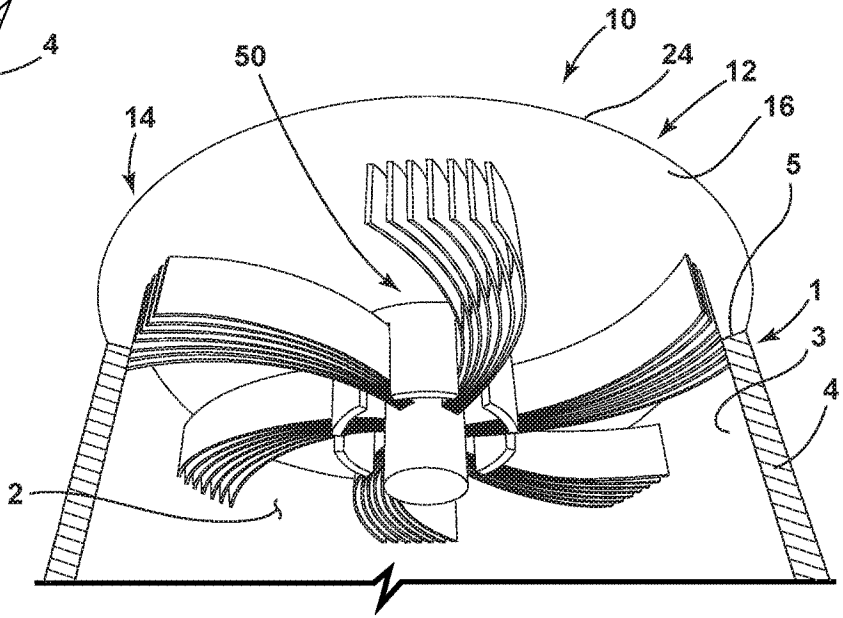
FIG. 2 is a bottom perspective view of the cover device of FIG. 1 with portions of the structure having the aperture shown in phantom.

Referring now to FIG. 2, the cover plate 12 of the cover device 10 is shown from a bottom perspective view positioned on the aperture 1, wherein the inner surface 16 of the cover plate 12 is shown positioned beyond an opening 5 into the receiving well 2 of the aperture 1. In this way the cover plate 12 is properly sized to cover the entire opening 5 of the aperture 1, such that no portion of the receiving well 2 of the aperture 1 is exposed. In the embodiment of FIG. 2, a portion of the sidewall 4 of the aperture 1 is shown in a transparent manner to reveal a deployable retainer mechanism 50. The specific portions of the retainer mechanism 50 and the function thereof are further described below.

Figure 3:
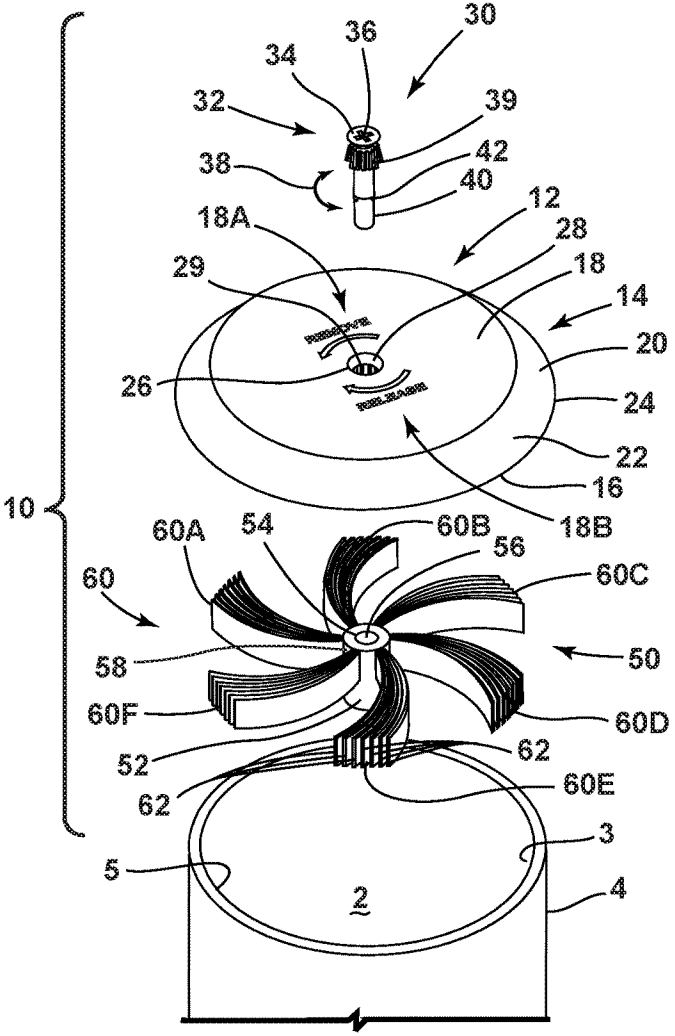
FIG. 3 is an exploded top perspective view of the cover device of FIG. 1 showing the components of the cover device exploded away from the aperture.
Figures 11A, 11B:
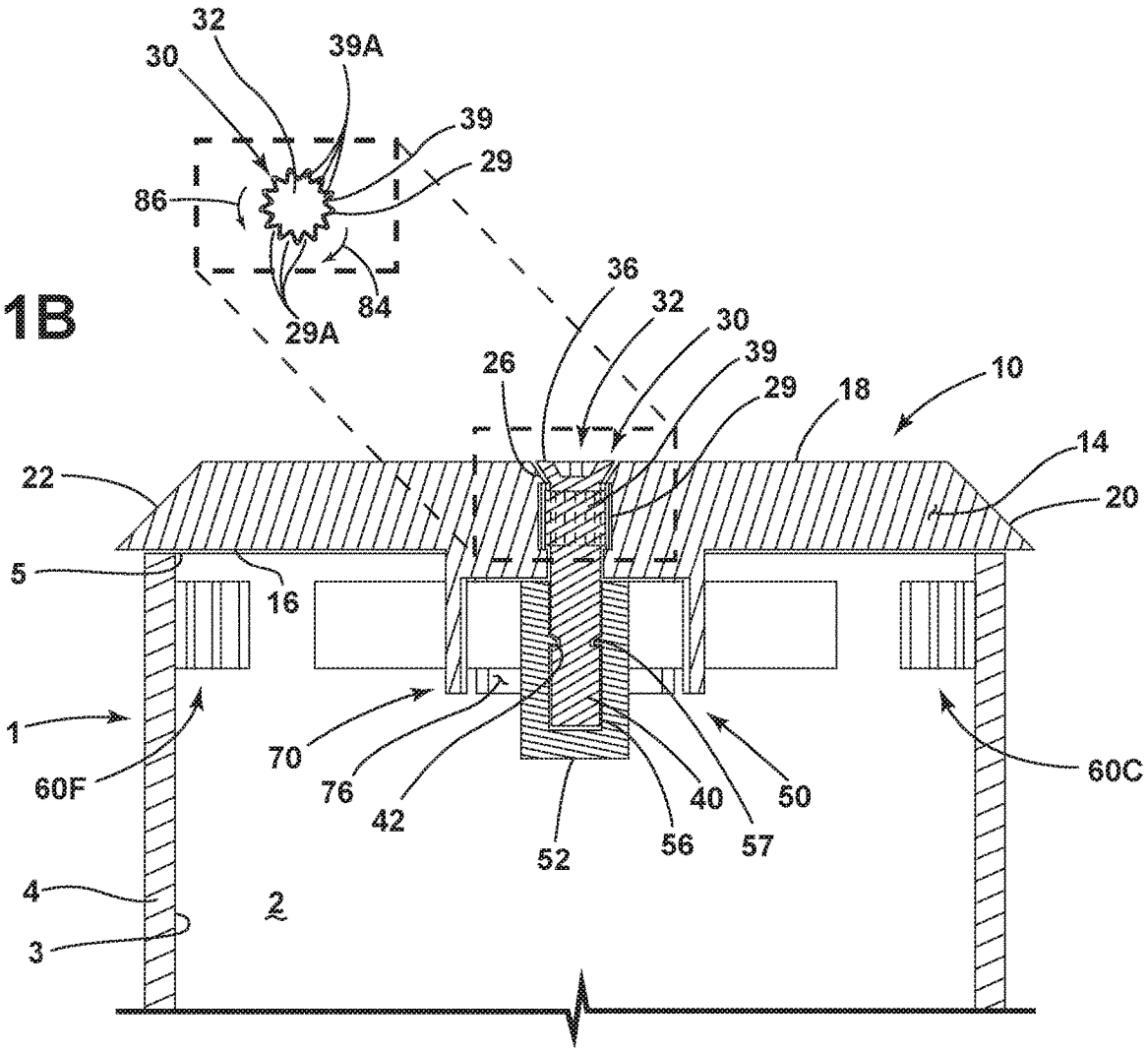
FIG. 11A is side elevational view of the cover device of FIG. 8.
FIG. 11B is a partial top plan view of interconnecting features disposed between the adjustment mechanism and cover plate of FIG. 11A.

Referring now to FIG. 3, the adjustment mechanism 30 is shown having the fastener 32 thereof removed and exploded away from the receiving aperture 26 of the cover plate 12. With the adjustment mechanism 30 removed from the receiving aperture 26, a beveled top edge 28 of the receiving aperture 26 is revealed. Further, a splined engagement member 29 is shown positioned in the receiving aperture 26 within the body portion 14 of the cover plate 12. The splined engagement member 29 is configured to engage a splined collar 39 disposed on a shaft portion 40 of the fastener 32 below the head portion 34 thereof. The shaft portion 40 includes an inset portion 42 for interconnecting the adjustment mechanism 30 with the deployable retainer member 50. The splined collar 39 of the adjustment mechanism 30 is configured to gearingly engage the splined engagement member 29 of the receiving aperture 26, such that the driving rotation of the fastener 32 by a user can further drive rotation of the splined engagement member 29 within the body portion 14 of the cover plate 12. Engagement between the splined engagement member 29 and the splined collar 39 is illustrated in FIG. 11B. While a splined or tooth gear style engagement is shown in FIGS. 3 and 11B, any other type of engagement between the engagement member 29 and collar 39 can be used for purposes of the present concept. The splined engagement member 29 is contemplated to provide a controlled rotation of the fastener 32 along the rotational path as indicated by arrow 38, such that a user can move engagement features 60 from a retracted position to a deployed position in a controlled manner, as further described below. Further, it is contemplated that the splined engagement member 29 can provide directional rotation only, such that the fastener 32 of the adjustment mechanism 30 may be rotated in only a single direction if desired. The splined engagement member 29 is also contemplated to provide a limit of rotation of the fastener 32 along the rotational path 38, such that the rotational limits imparted by the splined engagement member 29 can correspond to fully deployed and fully retracted positions of the engagement features 60 without allowing for over rotation in any one direction. Further, it is contemplated that the splined engagement member 29 may me a fixed member that allows for rotational movement of the fastener 32 in a first direction corresponding to a deployment of the engagement features 60, yet resists rotational movement of the fastener 32 in a second direction (that is opposed to the first direction) corresponding to a retraction of the engagement features 60. Finally, the splined engagement member 29 may me a static of fixed member that does not rotate and allows for rotational movement of the fastener 32 in the first and second directions by having flexibly resilient engagement teeth or splines 29A (FIG. 11B). In such a configuration, the splined engagement member 29 provides interference to the rotational movement of the fastener 32 ensure that rotation of the fastener 32, and corresponding deployment and retraction of the engagement features 60, is controlled.

As further shown in FIG. 3, the deployable retainer mechanism 50 includes a centrally-disposed support member 52 having a receiving aperture 54 disposed thereon. The receiving aperture 54 opens into a hollow interior 56 of the support member 52. The shaft portion 40 of the fastener 32 is configured to be received in the hollow interior 56 of the support member 52. Extending outwardly from an outer surface 58 of the support member 52 is a plurality of engagement features 60 which is comprised of individual engagement features 60A-60F. The engagement features 60A-60F are contemplated to be deployable engagement features that are operable between deployed and retracted positions. The adjustment mechanism 30 is used to rotate the support member 52 of the deployable retainer mechanism 50 to move the engagement features 60A-60F between retracted and deployed positions. Thus, the fastener 32 of the adjustment mechanism 30 defines an interconnecting member that interconnects the cover plate 12 with the deployable retainer mechanism 50 for adjusting the position of the engagement features 60A-60F by rotation of the fastener 32 along the rotation path as indicated by arrow 38. In the embodiment shown in FIG. 3, each of the engagement features 60A-60F includes a plurality of individual members 62 as specifically identified with respect to engagement feature 60E. It is contemplated that the engagement features 60A-60F can include multiple individual members 62, or the engagement features 60A-60F may comprise a single member. The engagement features 60A-60F are contemplated to be flexible resilient features which can abut an exposed surface of an aperture, such as inner perimeter surface 3 of aperture 1, to hold the cover device 10 in place on the aperture, as further described below.

Figure 4:
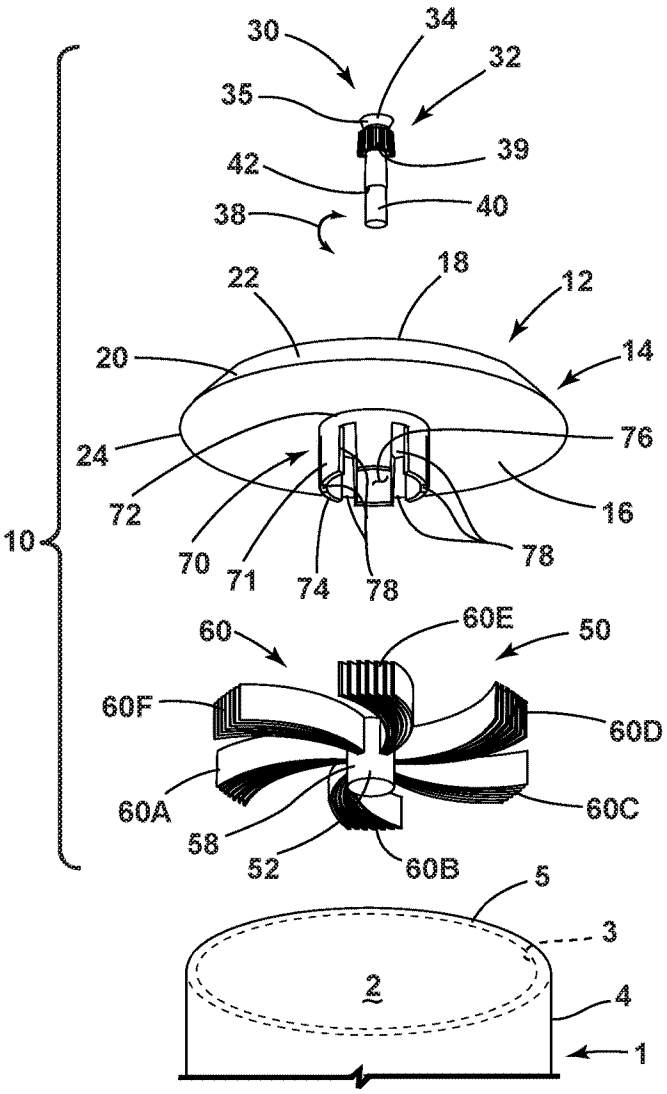
FIG. 4 is an exploded bottom perspective view of the cover device and aperture of FIG. 3.
Figure 5:
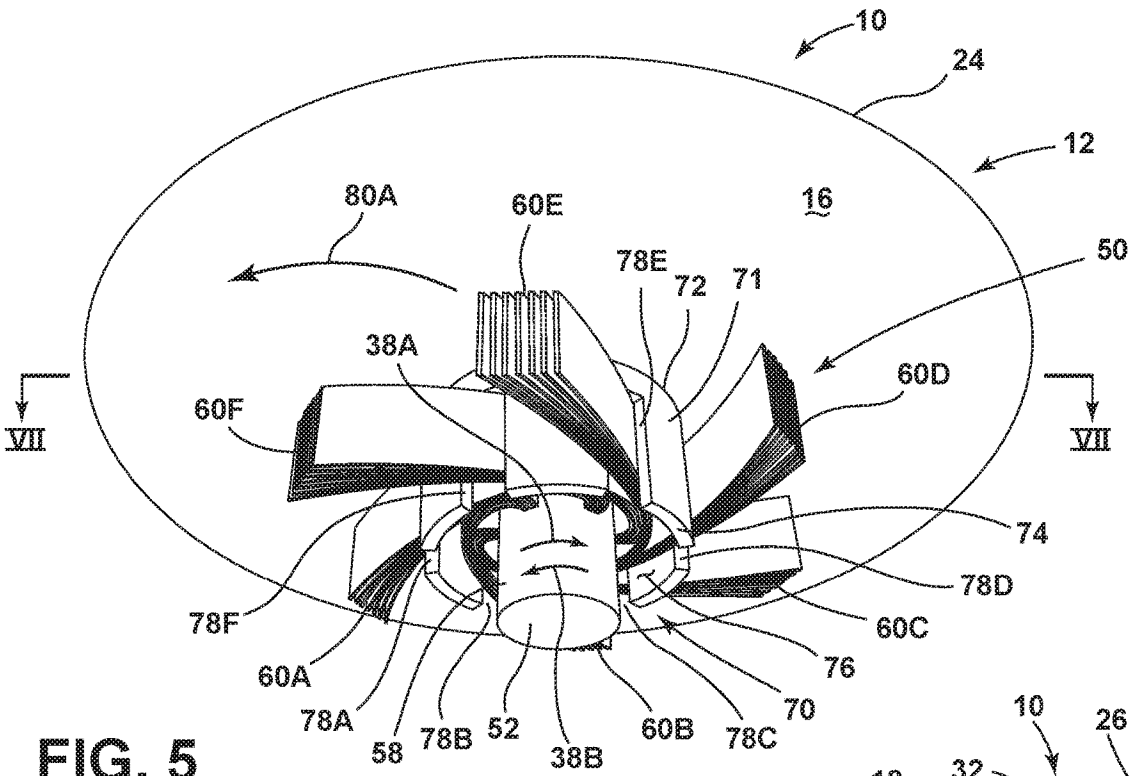
FIG. 5 is a bottom perspective view of the cover device of FIG. 1 showing engagement features of a retainer mechanism in a retracted position.

Referring now to FIG. 4, the cover device 10 is shown from an exploded bottom perspective view, wherein a guide member 70 is shown disposed on the inner side 16 of the cover plate 12. Specifically, the guide member 70 extends outwardly from the inner side 16 of the cover plate 12 and is configured to be received in the receiving well 2 of the aperture 1, when the cover device 10 is installed over the aperture 1. The guide member 70 includes a sidewall 71 having a base portion 72 and a distal end 74. The base portion 72 is coupled to the inner side 16 of the cover plate 12 and the distal end 74 is positioned away from the base portion 72. The sidewall 71 includes a plurality of recesses 78 disposed through the sidewall 71. Each recess 78 corresponds to an engagement feature 60A-60F. Thus, the retainer mechanism 50 is shown having six individual engagement features 60A-60F, all of which correspond to one of the six recesses 78 disposed along the sidewall 71 of the guide member 70. The guide member 70 is a stationary member having a receiving well 76 in which the support member 52 of the deployable retainer mechanism 50 is rotatably received, in assembly (as shown in FIG. 5). With the support member 52 of the deployable retainer mechanism 50 rotatably received in the receiving well 76 of the guide member 70, the individual engagement features 60A-60F extend out from the support member 52 and through the guide member 70 via the recesses 78 disposed along the sidewall 71 of the guide member 70.

Figure 6:
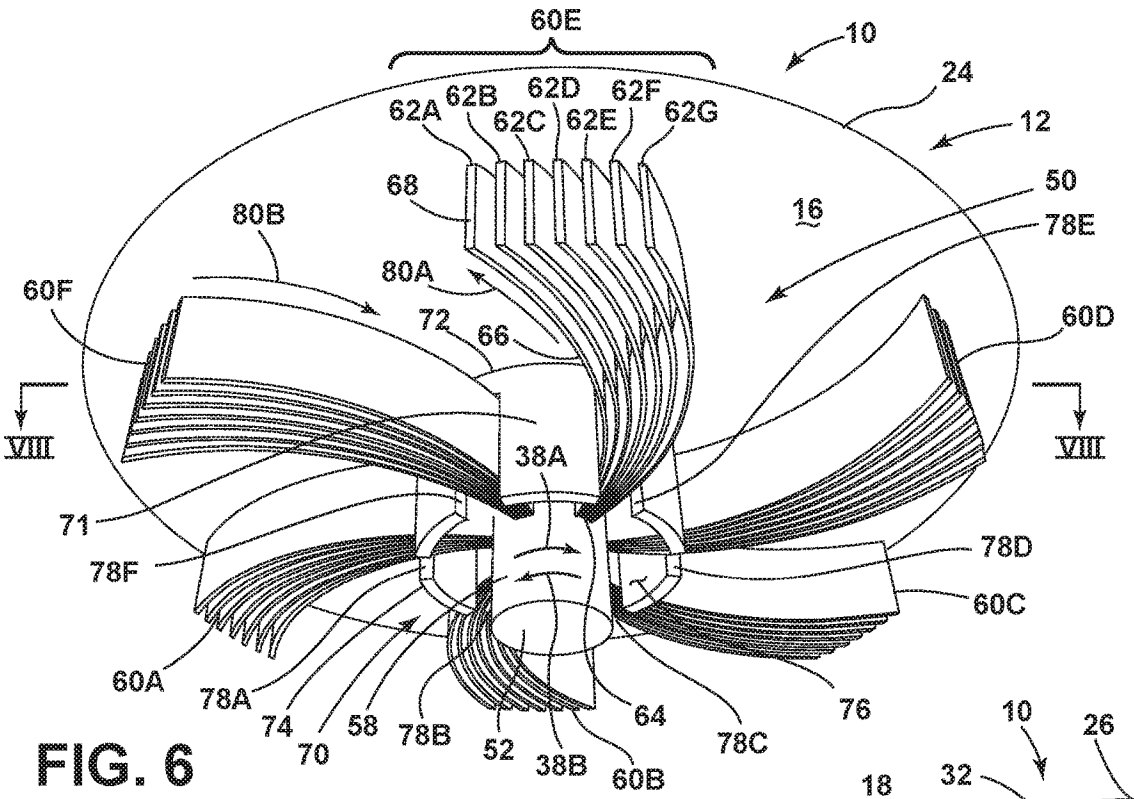
FIG. 6 is a bottom perspective view of the cover device of FIG. 5 showing the engagement features of the retainer mechanism in a deployed position.

Referring now to FIG. 5, the cover device 10 is shown in an assembled condition, wherein the support member 52 of the deployable retainer mechanism 50 is shown received in the receiving well 76 of the guide member 70. As noted above, the sidewall 71 of the guide member 70 extends outwardly from the inner side 16 of the cover plate 12. The base portion 72 of the guide member 70 is coupled to the inner side 16 of the cover plate 12 and the distal end 74 is positioned away from the base portion 72. The recesses 78 of guide member 70 are labeled as recesses 78A-78F, as the recesses 78A-78F correspond to the engagement features 60A-60F, respectively. Thus, the six individual engagement features 60A-60F extend outwardly from the support member 52 and through the guide member 70 via the respective recesses 78A-78F disposed along the sidewall 71 of the guide member 70. As noted above, the support member 52 of the deployable retainer mechanism 50 is rotatably received in the receiving well 76 of the guide member 70, in assembly. With the support member 52 of the deployable retainer mechanism 50 rotatably received in the receiving well 76 of the guide member 70, the individual engagement features 60A-60F are configured to move between retracted and deployed positions. In FIG. 5, the individual engagement features 60A-60F are shown in retracted positions as the support member 52 of the deployable retainer mechanism 50 has coiled portions of the engagement features 60A-60F to partially draw the engagement features 60A-60F into the receiving well 76 of the guide member 70. This retraction of the engagement features 60A-60F is provided by a user rotating the adjustment mechanism 30 in the clockwise direction (the RELEASE direction indicated in FIG. 1) to move the support member 52 of the deployable retainer mechanism 50 in the direction as indicated by arrow 38B. To move the engagement features 60A-60F to the deployed position (as shown in FIG. 6), a user will rotate the adjustment mechanism 30 in the counter clockwise direction (the REMOVE direction indicated in FIG. 1) to move the support member 52 of the deployable retainer mechanism 50 in the direction as indicated by arrow 38A. Movement of the support member 52 of the deployable retainer mechanism 50 in the direction as indicated by arrow 38A will cause for the engagement features 60A-60F thereof to extend outwardly along the deployment path as indicated by arrow 80A. This outward movement of the engagement features 60A-60F brings the engagement features 60A-60F into contact with structural features of an aperture over which the cover plate 12 is positioned. As shown in FIG. 5, the outward movement of the engagement features 60A-60F is a curved outward movement towards the outer perimeter 24 of the cover plate 12.

Referring now to FIG. 6, the individual engagement features 60A-60F are shown in deployed positions as the support member 52 of the deployable retainer mechanism 50 has paid out the formerly coiled portions of the engagement features 60A-60F from the receiving well 76 of the guide member 70. This deployment of the engagement features 60A-60F is provided by a user rotating the adjustment mechanism 30 in the counter clockwise direction (the REMOVE direction indicated in FIG. 1) to move the support member 52 of the deployable retainer mechanism 50 in the direction as indicated by arrow 38A. This rotation of the support member 52 of the deployable retainer mechanism 50 moves the engagement features 60A-60F outwardly along the curved deployment path as indicated by arrow 80A. To move the engagement features 60A-60F back to the retracted position (FIG. 5) from the deployed position (as shown in FIG. 6), a user will rotate the adjustment mechanism 30 in the clockwise direction (the RELEASE direction indicated in FIG. 1) to move the support member 52 of the deployable retainer mechanism 50 in the direction as indicated by arrow 38B. Movement of the support member 52 of the deployable retainer mechanism 50 in the direction as indicated by arrow 38B will cause for the engagement features 60A-60F thereof to retract and coil within the receiving cavity 76 of the guide member 70 along the curved retraction path indicated by arrow 80B. This outward movement of the engagement features 60A-60F brings the engagement features 60A-60F into contact with structural features of an aperture over which the cover plate 12 is positioned, as best shown in FIGS. 8 and 9.

As further shown in FIG. 6, engagement feature 60E has been further analyzed as a representative engagement feature for all of the engagement features 60A-60F of the deployable retainer mechanism 50. Specifically, engagement feature 60E is shown as having seven individual members 62A-62G. Each member 62A-62G includes a base portion 64, a body portion 66, and a distal end 68 (as shown in FIG. 6 with regards to member 62A). The base portion 64 is coupled to the support member 52. This coupling can be any type of coupling known in the art, such as a heat stack, ultrasonic welding, or other like coupling technique. It is contemplated that the support member 52 and the individual members 62A-62G of the engagement feature 60E are comprised of polymeric parts that can be coupled to one another use known coupling measures. As the individual members 62A-62G of the engagement feature 60E move to the deployed position from the retracted position, the distal ends 68 fan out to engage a structural feature of an aperture. The body portions 66 of the individual members 62A-62G of the engagement feature 60E are flexible resilient and can bend or flex when a structural feature of an aperture is contacted. Further, the flexible nature of the individual members 62A-62G of the engagement feature 60E allows for the members 62A-62G to coil into themselves if the deployable retainer mechanism 50 is over deployed. Having multiple individual members 62A-62G for the engagement features 60A-60F allows for the engagement features to maximize contact with the structural features of an aperture, which may be rough and irregular. While the embodiment shown in FIG. 6 includes the engagement features 60A-60F having individual members 62A-62G, it is contemplated that the engagement features 60A-60F may be single unitary members made from a polymeric material, such as a flexible plastic or a flexible foam material. Further, it is contemplated that each engagement feature 60A-69F may include more individual members or less individual members than illustrated in FIG. 6.

Figure 7:
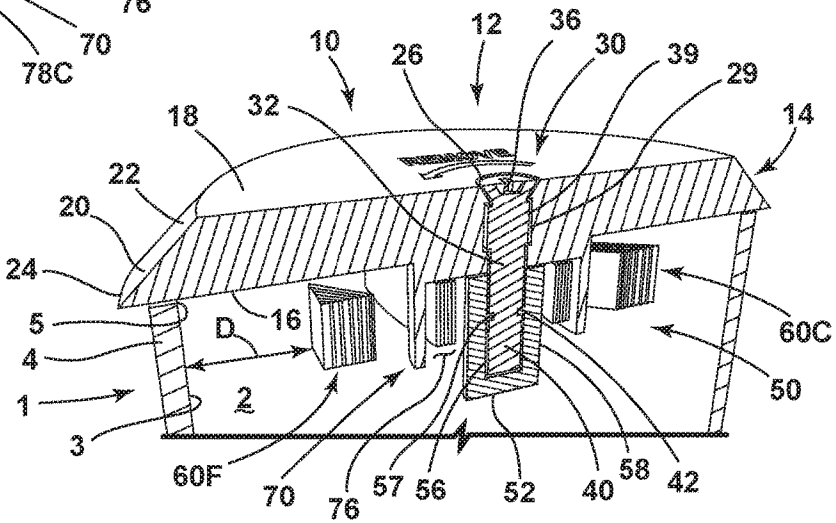
FIG. 7 is a cross-sectional top perspective view of the cover device of FIG. 5 positioned on a structure having an aperture taken along line VII of FIG. 5.

Referring now to FIG. 7, the cover device 10 is shown received over the opening 5 of the aperture 1. The support member 52 and guide member 70 are shown extending downwardly from the inner surface 16 of the cover plate 12 into the receiving well 2 of the aperture 1. Thus, the individual engagement features 60A-60F are aligned with a structural feature of the aperture 1, namely, the inner perimeter surface 3 of aperture 1. In FIG. 7, the individual engagement features 60A-60F are shown in retracted positions as the support member 52 of the deployable retainer mechanism 50 has partially coiled portions of the engagement features 60A-60F into the receiving well 76 of the guide member 70. The engagement features 60 are shown spaced-apart from the inner perimeter surface 3 of aperture 1 a distance D. Thus, the cover device 10 can be set in-place over the opening 5 of the aperture 1 in a quick and easy manner as the engagement features 60 are retracted and readily received within the receiving well 2 of the aperture 1.

Figure 8:
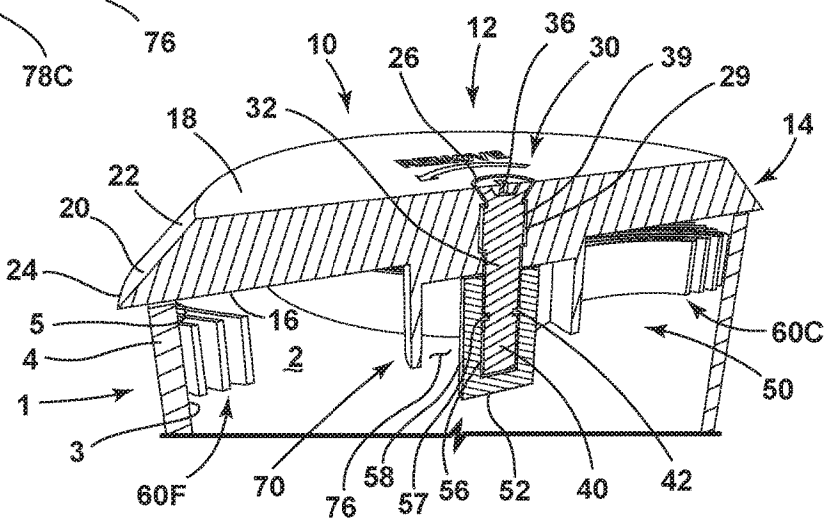
FIG. 8 is a cross-sectional top perspective view of the cover device of FIG. 6 positioned on a structure having an aperture taken along line VIII of FIG. 6.
Figure 9:
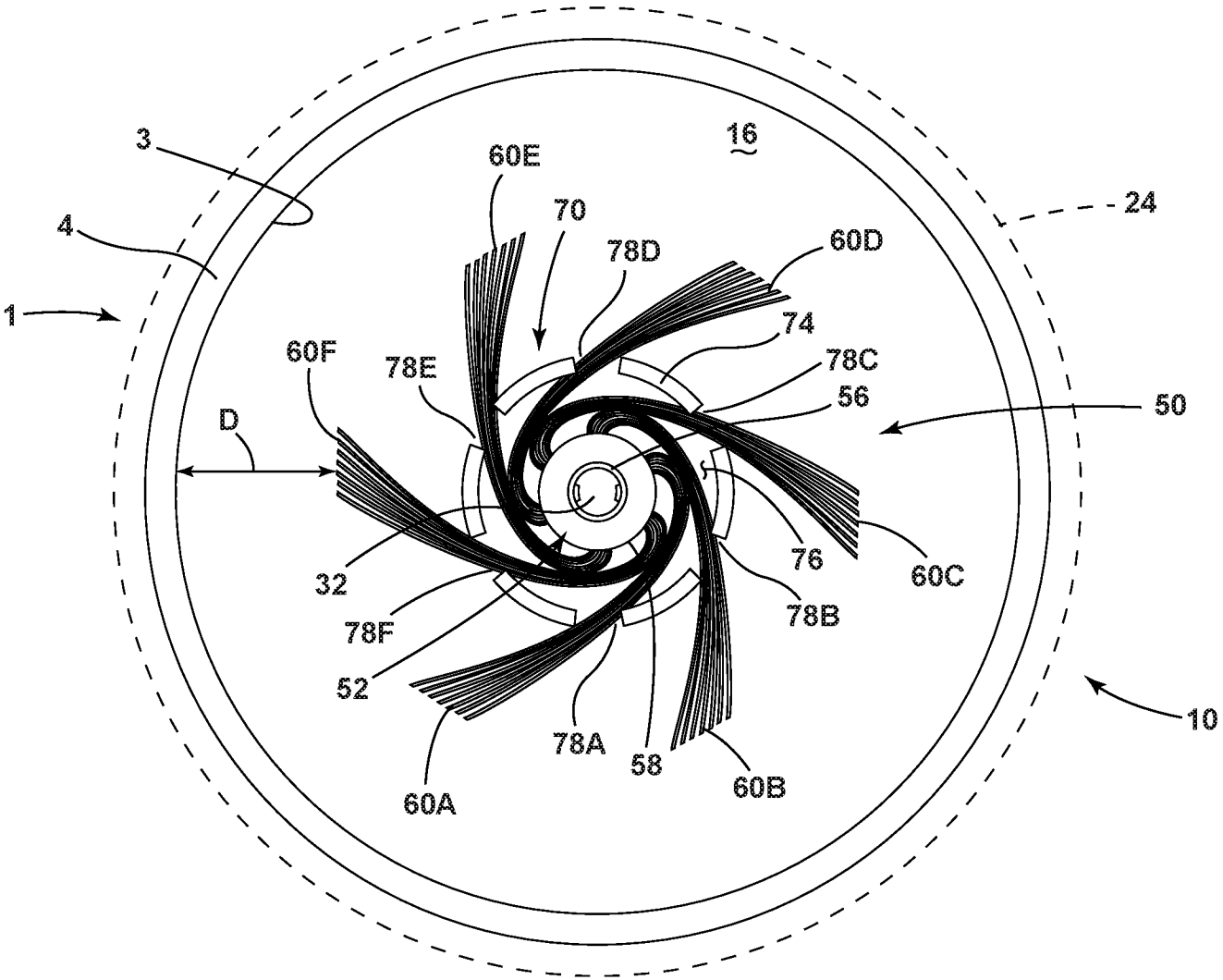
FIG. 9 is a bottom plan view of the cover device of FIG. 1 with the engagement features of the retainer mechanism shown in the retracted position.

Referring now to FIGS. 7 and 8, the fastener 32 is shown as received in receiving aperture 26 of the cover plate 12, and the shaft portion 40 of the fastener 32 of the adjustment mechanism 30 is shown coupled to an inwardly extending flange 57 disposed within the inner cavity 56 of the support member 52 of the deployable retainer mechanism 50. Specifically, the inwardly extending flange 57 is shown as being received in the inset portion 42 of the shaft portion 40. This coupling is contemplated to be a press-fit coupling between the shaft portion 40 of the fastener 32 and the inner cavity 56 of the support member 52. Further, the splined collar 39 disposed on the shaft portion 40 of the fastener 32 is shown as being engaged with the splined engagement member 29 of the cover plate 12 for controlling rotation of the fastener 32, and therefore, controlling deployment of the engagement features 60A-60F. Engagement between the splined collar 39 and the splined engagement member 29 is further described below with reference to FIGS. 11A and 11B.

Referring again to FIG. 8, the cover device 10 is shown engaged with the aperture 1. Specifically, the cover device 10 is shown with the deployable retainer mechanism 50 in the deployed position, such that the individual engagement features 60A-60F are deployed and engaged with the inner perimeter surface 3 of the aperture 1 in an abutting relationship. In this way, the cover device 10 is secured to the aperture 1, as the engagement features 60A-60F retain the cover device 10 in place on the aperture. Engagement between the aperture 1 and the cover device 10 is further described below with reference to FIGS. 9 and 10.

Referring now to Referring now to FIG. 9, the engagement features 60A-60F of the deployable retainer mechanism 50 are shown in the retracted position. In the retracted position, the engagement features 60A-60F are spaced away from the inside perimeter surface 3 of the aperture 1 a distance D, such that the engagement features 60A-60F are not engaged with the inner perimeter surface 3 of the aperture 1. In this way, a user can set the cover device 10 in-place on an open aperture without interference from the engagement features 60A-60F when the engagement features 60A-60F are in the retracted position. As set in-place on the aperture 1, the perimeter 24 of the inner surface 16 of the cover device 10 is shown spaced outwardly from the opening 5 of the aperture 1. In this, way, the inner surface 16 of the cover device 10 partially abuts a support surface in which the aperture 1 is disposed. As shown in FIG. 9, the engagement features 60A-60F are partially coiled around the support member 52 within the cavity 76 of the guide member 70 in the retracted position. The distance D between the engagement features 60A-60F is covered by the engagement features 60A-60F when the engagement features 60A-60F are deployed by a user from the retracted position to the deployed position, as shown in FIG. 10.

Figure 10:
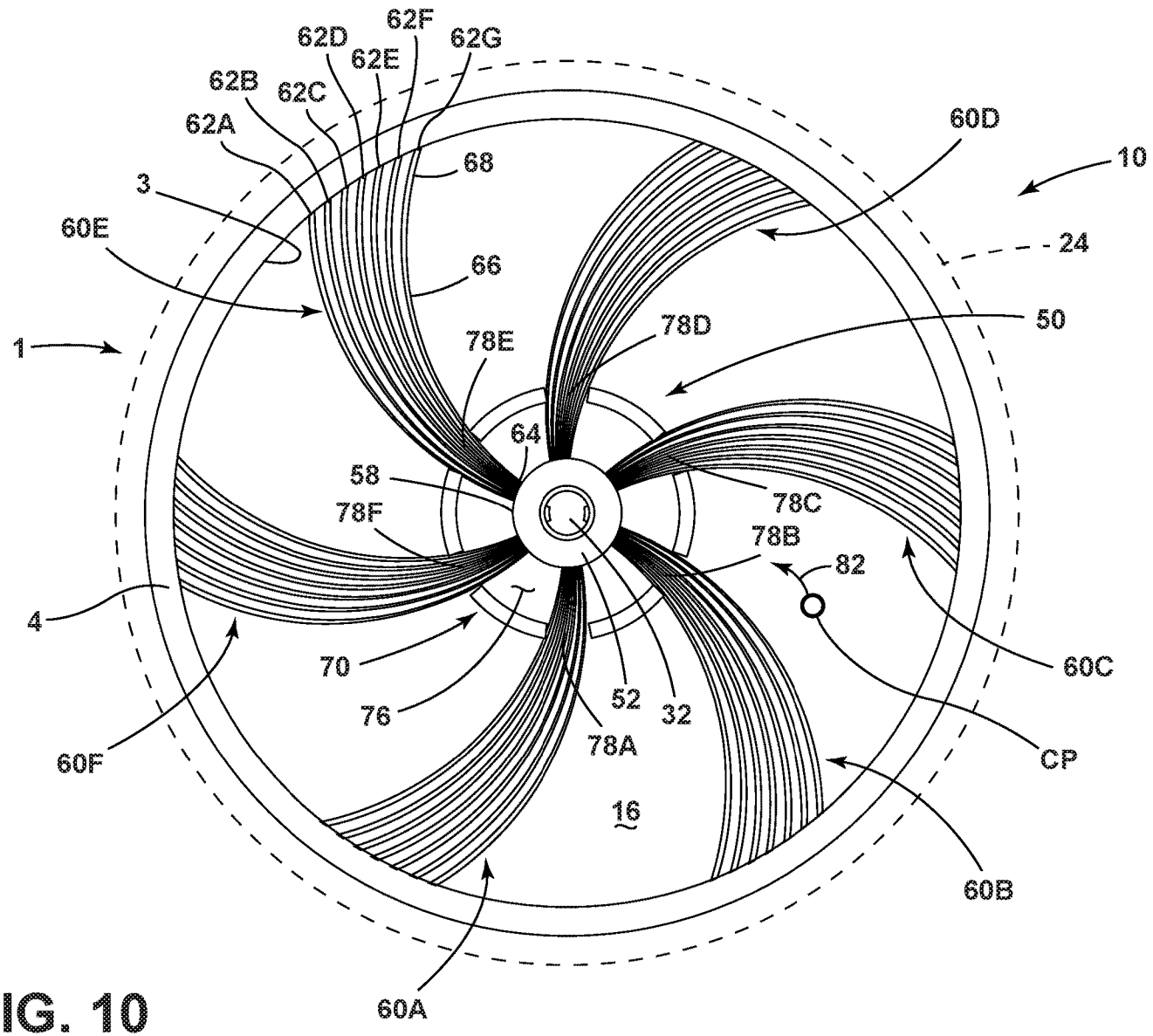
FIG. 10 is a bottom plan view of the cover device of FIG. 9 with the engagement features of the retainer mechanism shown in the deployed position.

Referring now to FIG. 10, the engagement features 60A-60F are shown having been deployed by a user from the retracted position to the deployed position. Thus, with specific reference to engagement feature 60E, the distal ends 68 of the engagement features 60A-60F are shown engaged with the inner perimeter surface 3 of aperture 1. The body portions 66 of the engagement features 60A-60F are shown curving as the distal ends 68 of the engagement features 60A-60F are engaged with the inner perimeter surface 3 of aperture 1. With the engagement features 60A-60F being spaced-apart evenly from the guide member 70 and support member 52, the engagement features 60A-60F are configured to apply proportionate forces on the structural features of the aperture 1 when the engagement features 60A-60F are in the deployed position. By applying equal forces on the structural features of the aperture 1, the engagement features 60A-60F serve as self-centering features for the cover device 10. For example, if the cover device 10 were to be placed on the aperture 1, such that the cover device 10 were to have the illustrated center point CP when the engagement features 60A-60F were in the retracted position, then the engagement features 60C and 60B would exert a disproportionate amount of force on the inner perimeter surface 3 of the aperture 1 as the engagement features 60A-60F are deployed until the center point CP of the cover member moved inwardly (along the path indicated by arrow 82) towards the center point of the aperture 1. This movement would occur until the force imparted by all of the engagement features 60A-60F equalized, and the cover device 10 was centered on the aperture 1. Thus, greater force is exerted on the inner perimeter surface 3 of the aperture 1 by engagement features (such as engagement features 60C and 60B in FIG. 10 at exemplary center location CP) positioned closer to the inner perimeter surface 3 of the aperture 1, as compared to engagement features positioned further away from the inner perimeter surface 3 of the aperture 1 (such as engagement features 60E and 60F in FIG. 10 at exemplary center location CP). In this way, the deployable retainer mechanism is a self-centering mechanism that can center the cover device 10 on an aperture when the aperture is a round aperture, or when the aperture has a configuration that is uniform on an inner perimeter surface thereof. Thus, equalizing the force exerted by the engagement features 60A-60F around the circumference of the inner perimeter surface 3 of the aperture 1 serves to center the cover device 10 on the aperture opening 5.

Referring now to FIG. 11A, the cover device 10 is shown positioned on the opening 5 of the aperture 1. Specifically, the cover device 10 is shown engaged with inner perimeter surface 3 of the aperture 1 via the engagement features 60A-69F. With the deployable retainer mechanism 50 in the deployed position, the individual engagement features 60A-60F are deployed and engaged with the inner perimeter surface 3 of the aperture 1 in an abutting relationship, so as to center the cover device 10 on the opening 5 of the aperture 1. As further shown in FIG. 11A, the splined collar 39 of the adjustment mechanism 30 is gearingly engaged with the splined engagement member 29 disposed in the body portion 14 of the cover device 10. This geared relationship is further illustrated in FIG. 11B. With specific reference to FIG. 11B, splines 39A of the splined collar 39 of the adjustment mechanism 30 are engaged with splines 29A of the splined engagement member 29. The splines 29A of the splined engagement member 29 are configured to flex directionally to allow for easy movement in the rotational direction associated with the deployment of the engagement features 60A-60F, and resist movement in the direction associated with retraction of the engagement features 60A-60F. Thus, the interaction of the splined engagement member 29 with the splined collar 39 is configured to retain the engagement features 60A-60F in the deployed position once deployed. For example, if rotation of the adjustment mechanism 30 along the rotational path indicted by arrow 84 provides for deployment of the engagement features 60A-60F, then the splines 29A of the splined engagement member 29 can flex in this direction as well. In such an arrangement, it is contemplated that the splines 29A of the splined engagement member 29 will resist rotation of the adjustment mechanism 30 along the rotational path indicted by arrow 86. While rotation is resisted in the retraction movement of the adjustment mechanism 30, it is contemplated that such movement is not prohibited by the interaction of the splined engagement member 29 with the splined collar 39. In this way, the engagement features 60A-60F can be retracted when necessary by a user. However, it is contemplated that the force necessary to retract the engagement features 60A-60F of the deployable retainer mechanism 50 is greater than the force necessary to deploy the engagement features 60A-60F. Interference between the splined engagement member 29 and the splined collar 39 can provide directional resistance by the splines 29A being directionally flexible or the splines 39A being directionally flexible. So long as one of the splines (29A or 39A) is directionally flexible, and the other (29A or 39A) is substantially rigid, the retention of the engagement features 60A-60F in the deployed position is achieved.

Figure 12:
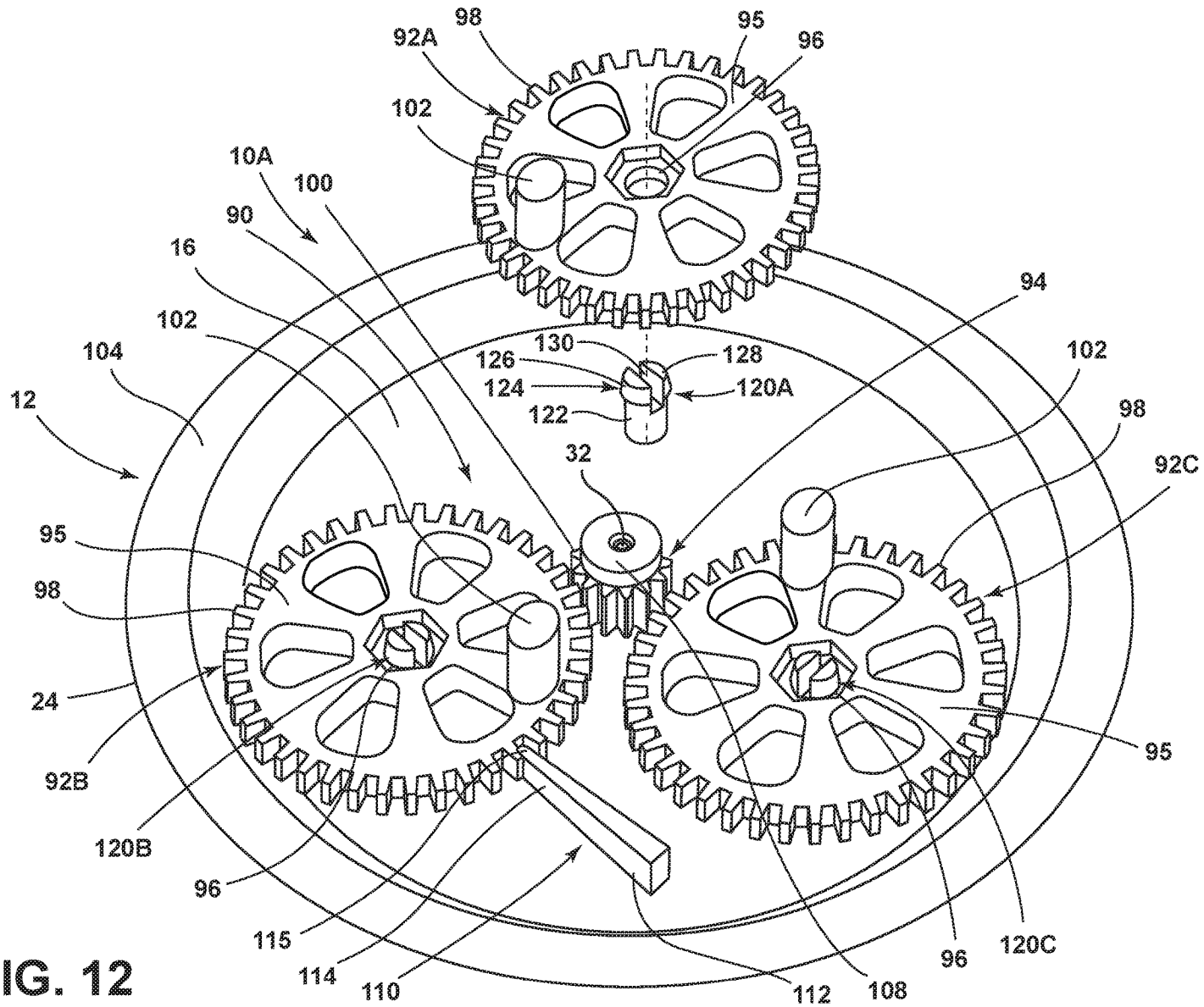
FIG. 12 is a bottom perspective view of another embodiment of a cover device showing a gear exploded away from a multi-gear system disposed on a cover plate.

Referring now to FIG. 12, another embodiment of a cover device 10A is shown having structural features in common with the cover device 10 described above. Common features shared between the cover device 10 and the cover device 10A will be indicated using like reference numerals. In the embodiment shown in FIG. 12, the cover device 10A includes a round cover plate 12 with a multi-gear deployable retainer system 90 disposed on the inner surface 16 thereof. In the embodiment of FIG. 12, the multi-gear deployable retainer system 90 includes three gears 92A, 92B and 92C which are interconnected by a centrally-disposed drive gear 94. Each gear 92A-92C includes a disc-shaped body portion 95 having a central mounting aperture 96 and a toothed outer rim 98. The toothed outer rim 98 of each gear 92A-92C is gearingly engaged with a toothed outer rim 100 of the drive gear 94. In this way, as the drive gear 94 rotates, the gearing engagement of the gears 92A-92C and the drive gear 94 causes the gears 92A-92C to rotate in an opposite rotational direction relative to a rotational direction of the drive gear 94. As further shown in FIG. 12, each gear 92A-92C also includes an engagement feature 102 outwardly extending from the body portion 95. Specifically, the engagement features 102 are configured to extend outwardly from the body portions 95, such that the engagement features 102 extend beyond a rim portion 104 of the cover plate 12. In this way, the cover device 10A can abut a surface at the rim portion 104 of the cover plate 12 over an aperture, and the engagement features 102 of the gears 92A-92C will extend beyond the cover plate 12 into the aperture to engage the inner perimeter surface of the aperture. A contemplated aperture is shown in FIG. 1 as aperture 1 having inner perimeter surface 3. In use, counterclockwise rotation of the drive gear 94, due to rotation of the adjustment mechanism 30, causes clockwise rotation of the gears 92A-92C until the engagement features 102 of the gears 92A-92C contact the inner perimeter surface 3 of an aperture 1 over which the cover device 10A is placed. Having multiple engagement features 102 in the multi-gear deployable retainer system 90, the cover device 10A is configured to self-center over an aperture and apply equalized pressure on an inner perimeter surface of the aperture at each of the engagement features 102.

As further shown in FIG. 12, a tensioner member 110 is mounted to the inner surface 16 of the cover plate 12. The tensioner member 110 is contemplated to include a first end 112 and a second end 114. The first end 112 may be mounted to the cover plate 12, while the second end 114 of the tensioner member 110 includes a distal tip that is shown engaged with the toothed outer rim 98 of gear 92B. The tensioner member 110 is configured to allow for rotation of the gear 92B in a first rotational direction, and prohibit rotation of the gear 92B in a second rotational direction, wherein the second rotational direction is an opposite rotational direction relative to the first rotational direction. Rotation in the second rotational direction is inhibited by the engagement of the second end 114 of the tensioner member 110 with the toothed outer rim 98 of gear 92B. Thus, the tensioner member 110 may be a one-way flexible member, or other like ratcheting style retaining feature known in the art. Further, the tensioner member 110 may be selectively engageable with the gear 92B, or may be in constant engagement with gear 92B. As all of the gears 92A-92C are interconnected by the drive gear 94, the prohibited rotation of gear 92B by tensioner member 110 in the second rotational direction further prohibits rotation of gears 92A, 92C in the same second rotational direction. As noted above, the tensioner member 110 may be selectively deployable and is configured to hold the gears 92A-92C of the multi-gear deployable retainer system 90 in-place when a desired tension is reached between engagement features 102 of the gears 92A-92C and an inner perimeter surface of an aperture. The tensioner member 110 may be configured to engage any one of the gears 92A-92C and is not limited to engagement with gear 92B alone. Further, multiple tensioner members can be used on the cover device 10A for engagement with multiple gears simultaneously. In FIG. 12, the drive gear 94 is shown being rotatably mounted to the inner surface 16 of the cover plate 12 and is retained in-place by a retainer member 108 positioned on fastener 32. An adjustment assembly, like the adjustment mechanism 30 described above with reference to FIGS. 1 and 7, is contemplated to be accessible from the outer surface 18 of cover device 10A for driving rotation of the drive gear 94, and the multi-gear deployable retainer system 90 coupled thereto, via fastener 32. It is further contemplated that the tensioner member 110 may be continuously engaged with one of the gears 92A-92B, and can prohibit the engaged gear from rotating in a particular direction that would retract the engagement features 102. In a continuously engaged embodiment, the tensioner member 110 can be overcome by a user through the adjustment mechanism 30 for rotating the engaged gears in a direction associated with deploying the engagement features 102.

As further shown in FIG. 12, gear 92A is shown exploded away from the inner surface 16 of the cover plate 12. Outwardly extending from the inner surface 16 of the cover plate 12 is a mounting post 120A which includes a base portion 122 and an engagement portion 124. The engagement portion 124 includes first and second engagement members 126, 128 which are spaced-apart from each other by a gap 130. The engagement members 126, 128 are contemplated to be flexibly resilient members received through the mounting aperture 96 of gear 92A. As the gear 92A is mounted to the mounting post 120A, the engagement portion 124 of the mounting post 120A will pass through the mounting aperture 96 of the gear 92A until the engagement members 126, 128 clear the upper side of the mounting aperture 96. So, the flexibly resilient engagement members 126, 128 will come together within the gap 130 to allow the passage of the gear 92A over the engagement members 126, 128, and then will resiliently reassume the resting position in which the engagement members 126, 128 are spaced-apart by the gap 130 to retain the gear 92A in-place on the inner surface 16 of the cover plate 12 of the cover device 10A in a rotatable manner. Gears 92B and 92C also include mounting posts 120B, 120C, respectively. The mounting posts 120B, 102C include similar features as those described above with reference to mounting post 120A. In this way, all of the gears 92A-92C are configured for snap-fit engagement with the cover plate 12. It is contemplated that the mounting posts 120A-120C are injection molded with the cover plate 12 to provide a unitary member.

As noted above, the gears 92A-92C will rotate until the engagement features 102 thereof extend away from the drive gear 94 towards the outer perimeter 24 of the cover plate 12 for engagement with an inner perimeter surface of an aperture. Once engaged with the inner perimeter surface of an aperture, the engagement features 102 will hold the cover device 10A in-place on the aperture, and the gears 92A-92C will be retained in place by the tensioner member 110 once a desired tension between the cover device 10A and the inner perimeter surface of the aperture is reached. Moving from the deployed position (FIG. 16C) to the retracted position (FIG. 16A), the gears 92A-92C will rotate in an opposite direction (as opposed to the direction associated with deployment of the engagement features), thereby drawing the engagement features 102 thereof towards the centrally-disposed drive gear 94 and away from the outer perimeter 24 of the cover plate 12. This retracting movement need not draw the engagement features 102 all the way to the nearest position relative to the drive gear 94 to a fully retracted position, but rather, the engagement features 102 need only disengage an aperture wall to be considered retracted.

Figure 13:
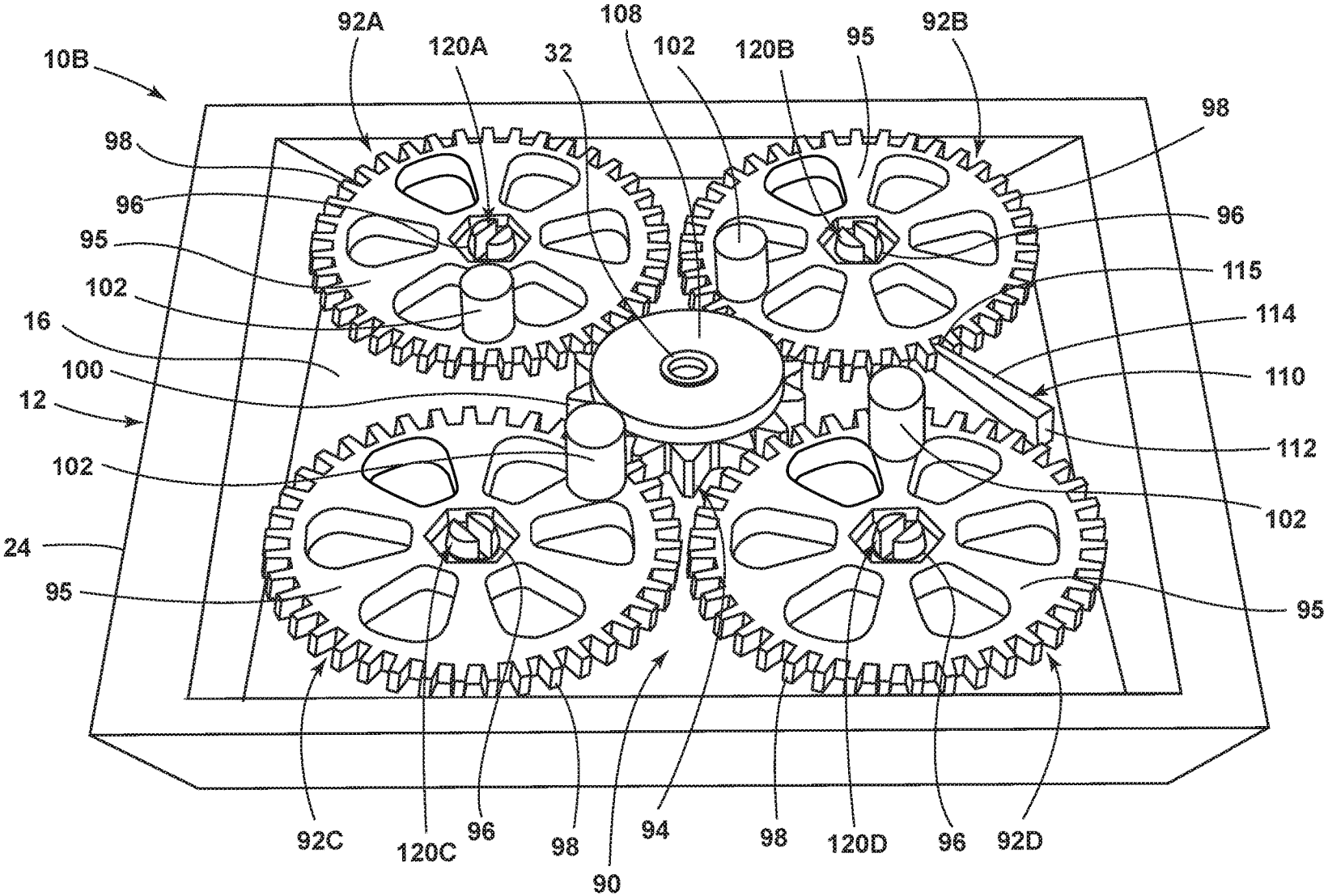
FIG. 13 is a bottom perspective view of another embodiment of a cover device having a multi-gear system disposed on a cover plate.

Referring now to FIG. 13, the cover device 10A includes a square-shaped cover plate 12. In this embodiment, the multi-gear deployable retainer system 90 includes four gears 92A-92D which are all interconnected by drive gear 94.

Figure 14:
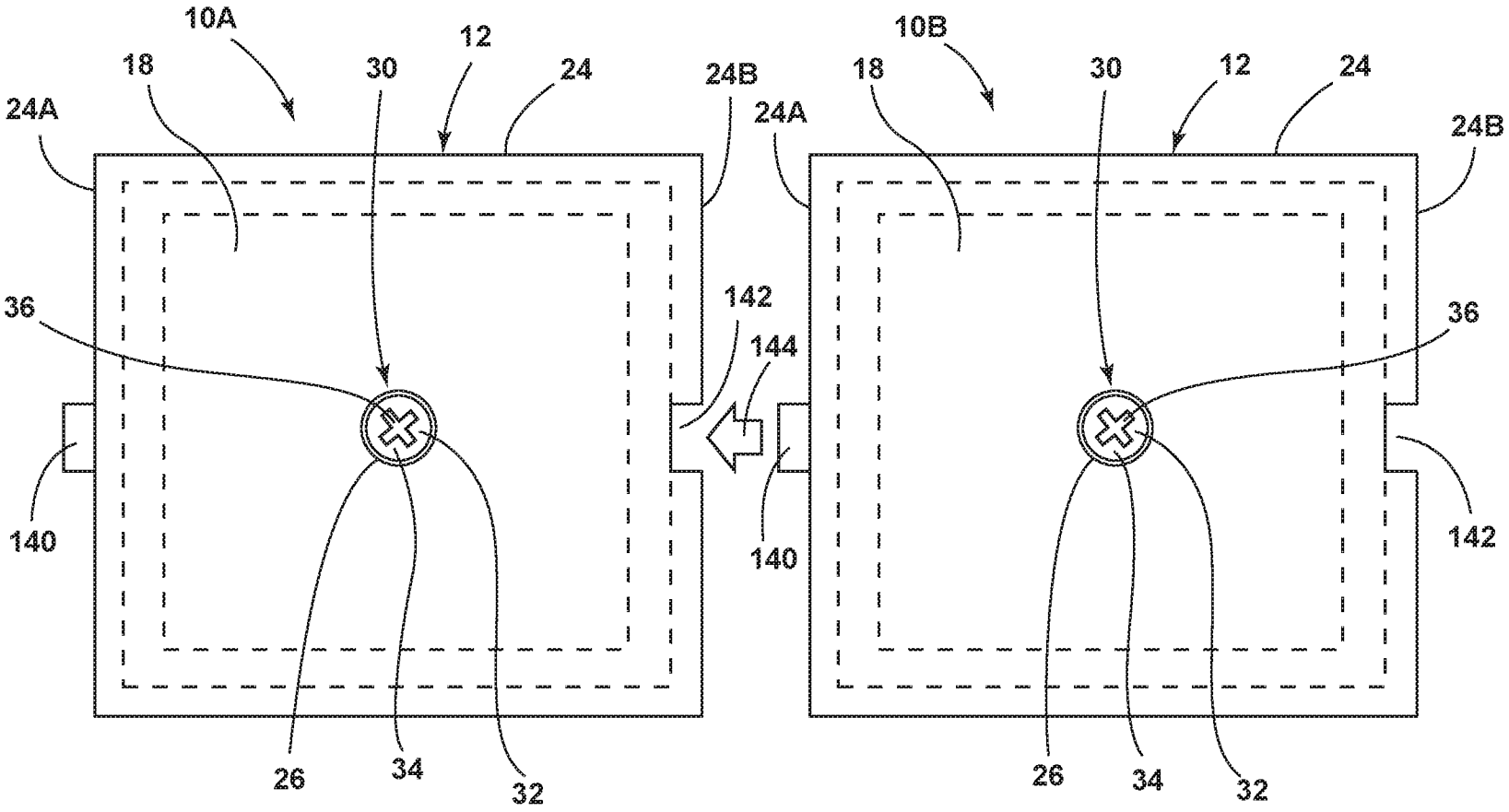
FIG. 14 is a top plan view of serially-aligned cover devices having interconnecting features.

Referring now to FIG. 14, the cover device 10A includes an interlocking feature for interconnecting serially-aligned cover devices. As specifically shown in FIG. 14, cover device 10A includes an interlocking tab 140 which outwardly extends from a first side 24A of the outer perimeter 24 of the cover plate 12. On a second side 24B of the outer perimeter 24 of the cover plate 12, an inset recess 142 is disposed. While the interlocking tab 140 and inset recess 142 are shown on opposed sides 24A, 24B of the outer perimeter 24 of the cover plate 12, it is contemplated that the interlocking tab 140 and inset recess 142 may be disposed along any portion of the cover plate 12 to facilitate the interconnection between serially-aligned cover devices. As further shown in FIG. 14 a second cover device 10B is orientated to be serially-aligned with cover device 10A. In a similar manner, with reference to cover device 10A, cover device 10B includes an interlocking tab 140 which outwardly extends from a first side 24A of the outer perimeter 24 of the cover plate 12 and an inset recess 142 disposed on a second side 24B. As illustrated in FIG. 14, the interlocking tab 140 of cover device 10B is configured to be received within the inset recess 142 of cover device 10A along the path as indicated by arrow 144 to thereby interconnecting the cover devices 10A, 10B to form an enlarged overall cover device that is capable of covering larger holes often encountered in various construction applications. It is contemplated that the interlocking tab 140 and inset recess 142 may include a dovetail cross-section, or other like geometrical mating combination, wherein the inset recess 142 includes a reciprocal configuration to the cross-section of the interlocking tab 140, such that aligned and coupled cover devices 10A, 10B are not easily decoupled in use. It is further contemplated that multiple cover devices can be interconnected using the tab and inset recess features described above to accommodate apertures of any size.

In FIG. 14, the adjustment mechanism 30 is positioned in a generally central portion of the cover plate 12 and includes the fastener 32 having the head portion 34 with the engagement portion 36 disposed thereon. The fastener 32 is shown disposed within the receiving aperture 26 disposed through the cover plate 12 between the inner and outer surfaces 16, 18 thereof. In use, the engagement portion 36 of the fastener 32 is contemplated to be engaged by a tool of a user (such as a screwdriver or power drill) for rotating the fastener 32 within the receiving aperture 26. Thus, the fastener 32 defines an engagement portion accessible from the outer surface 18 of the cover plate 12 for moving the plurality of engagement features 102 (FIG. 13) between retracted and deployed positions, as further described below.

Figure 15:
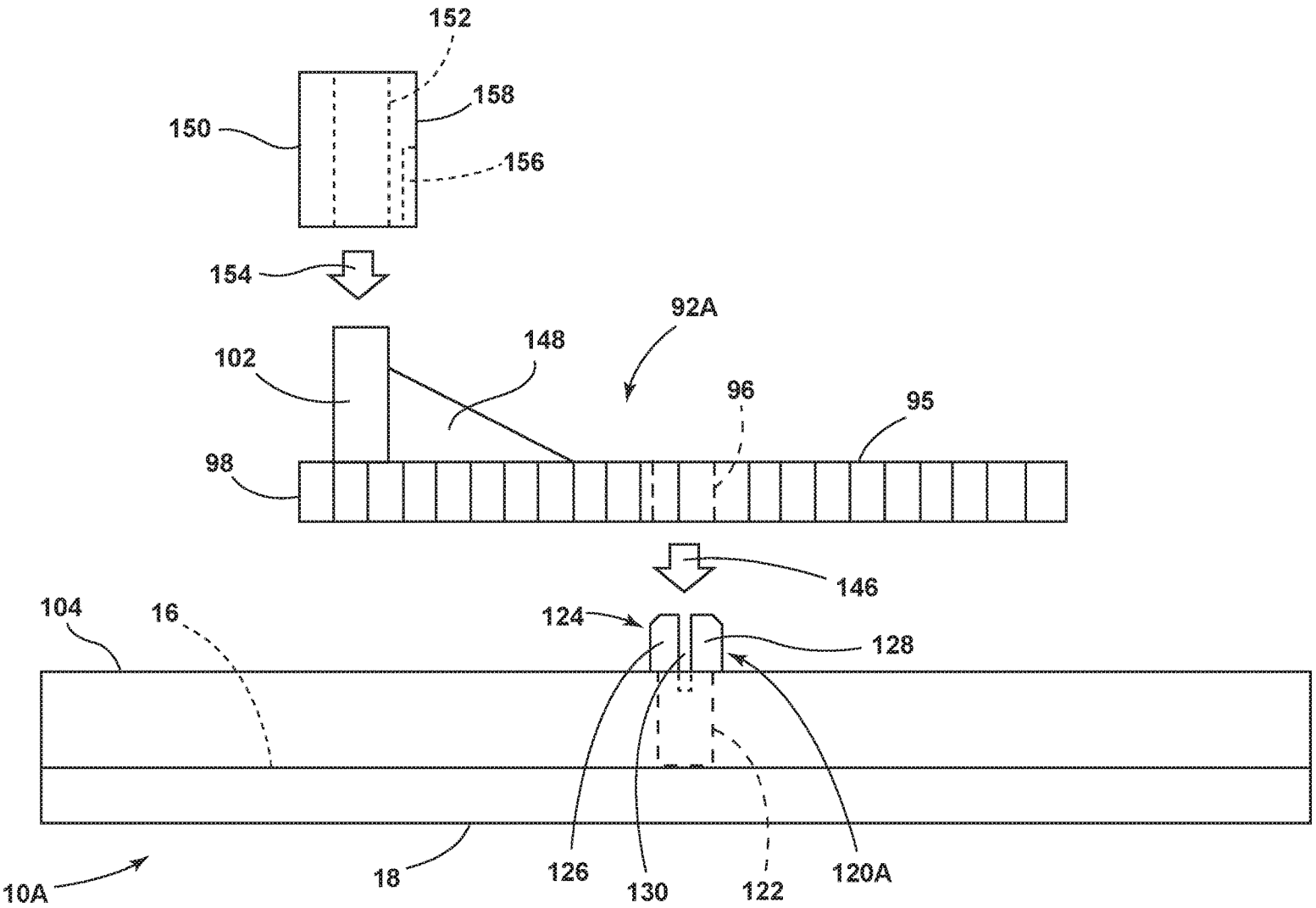
FIG. 15 is a side elevation view of the cover device of FIG. 12 showing the gear and a sleeve member exploded away from the cover plate.

Referring now to FIG. 15, gear 92A is shown being mounted on mounting post 120A of cover device 10A through mounting aperture 96 in the direction as indicated by arrow 146. Engagement feature 102 is shown extending outwardly from the body portion 95 of gear 92A and includes a wedge-shaped support member 148 coupled thereto that also extends outwardly from the body portion 95 of gear 92A to further support the engagement feature 102 against forces applied by the gear system to an inner perimeter surface of an aperture through the engagement feature 102. A sleeve member 150 is shown exploded away from engagement feature 102 and is configured for reception on engagement feature 102 in the direction as indicated by arrow 154. The sleeve member 150 includes an inner cavity 152 which is configured to receive the engagement feature 102 in assembly. The sleeve member 150 further includes a recess 156 which is provided to receive a portion of the wedge-shaped support member 148 to accommodate this additive supportive structure. The sleeve member 150 enlarges the profile of the engagement feature 102 and can be used to provide enlarged profiles to the engagement features 102 of any one of the gears included in the multi-gear deployable retainer system 90. Further, the sleeve member 150 includes an outer surface 158 which may be provided with a coating that is flexibly resilient or tacky in order to help provide grip to the cover device 10A as disposed on and engaged with an aperture. Further, it is contemplated that the sleeve member 150 may be entirely comprised of a flexibly resilient material to provide better engagement with an inner perimeter surface of an aperture. The flexibly resilient nature of the sleeve member 150 may be provided in a rubberized coating or a sleeve member 150 that is entirely comprised of a semi-flexible or elastic polymeric material. Further, it is contemplated that the engagement features 102 may be comprised of a softer material as compared to the body portion 95 of the gear 92A. This may be provided by a dual shot injection molding technique, or other formation process, wherein a first material is a rigid thermoplastic material used to form the body portion 95, and a second softer material is used to form the engagement feature 102, such that the engagement features have more elasticity and better griping power on an aperture.

Figure 16A:
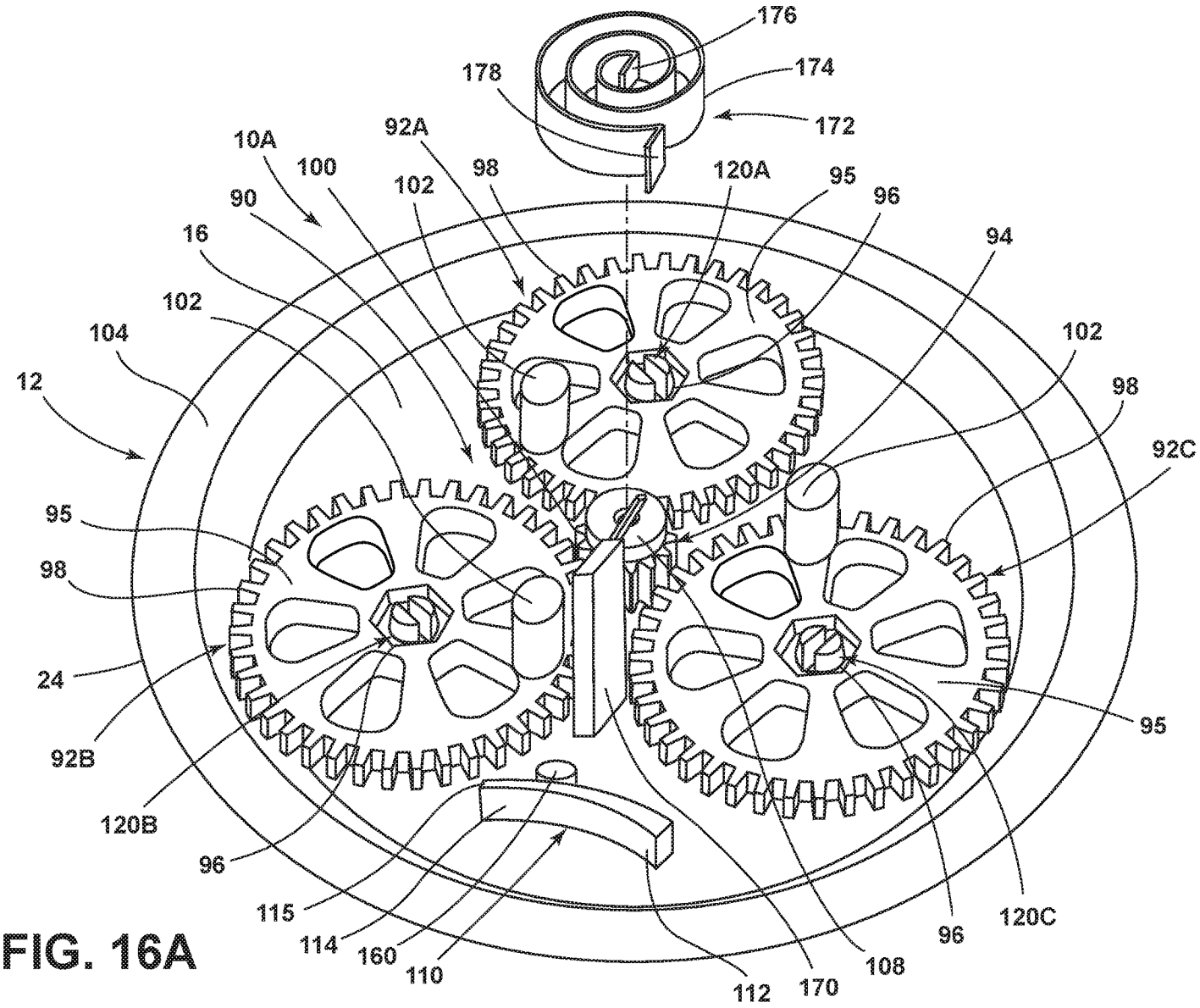
FIG. 16A is a bottom perspective view of the cover device of FIG. 12 showing a biasing member exploded away from the cover plate.
Figure 16B:
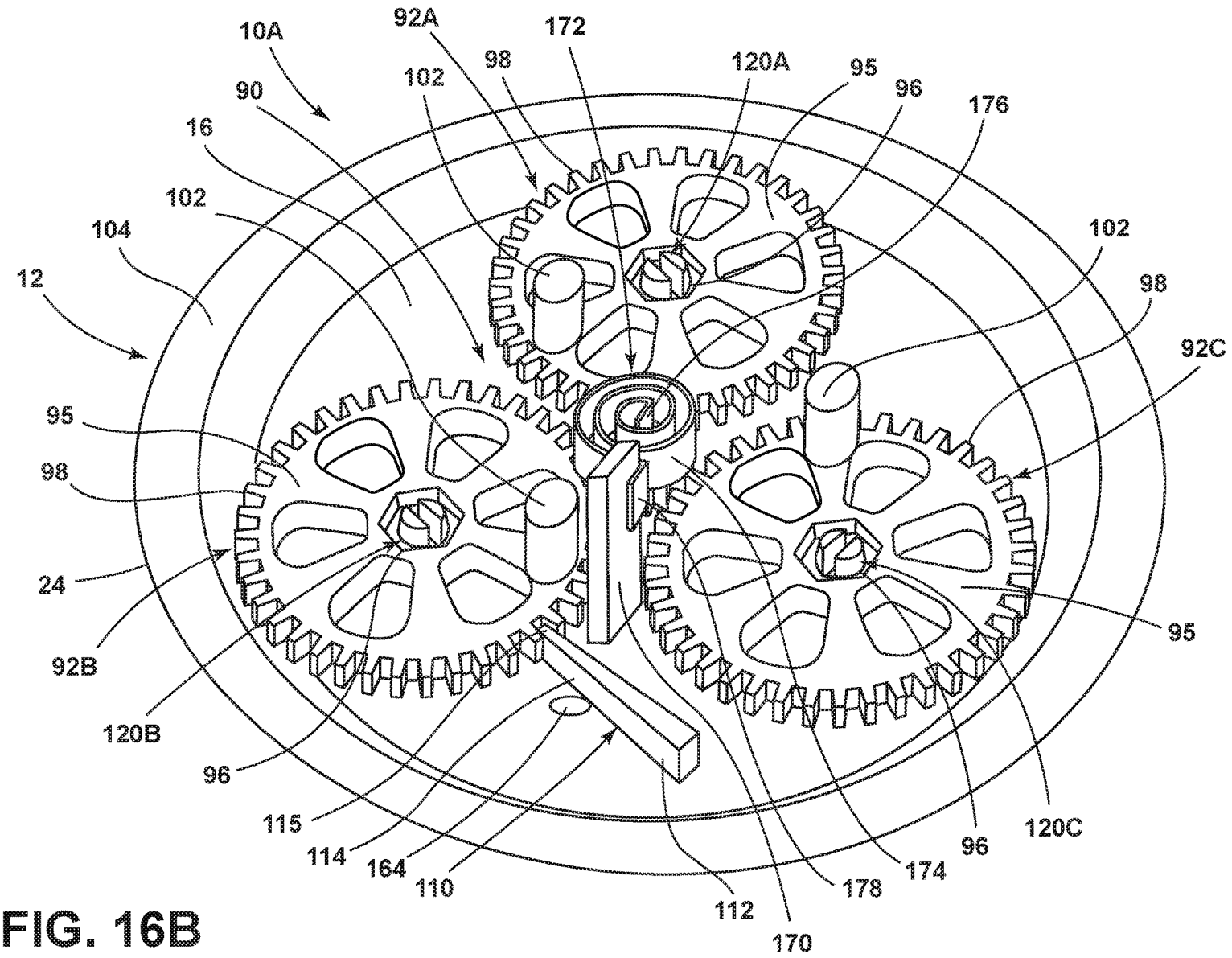
FIG. 16B is a bottom perspective view of the cover device of FIG. 16A showing the biasing member coupled to between the cover plate and the drive gear in a loaded condition with the engagement members in a retracted position.
Figure 17:
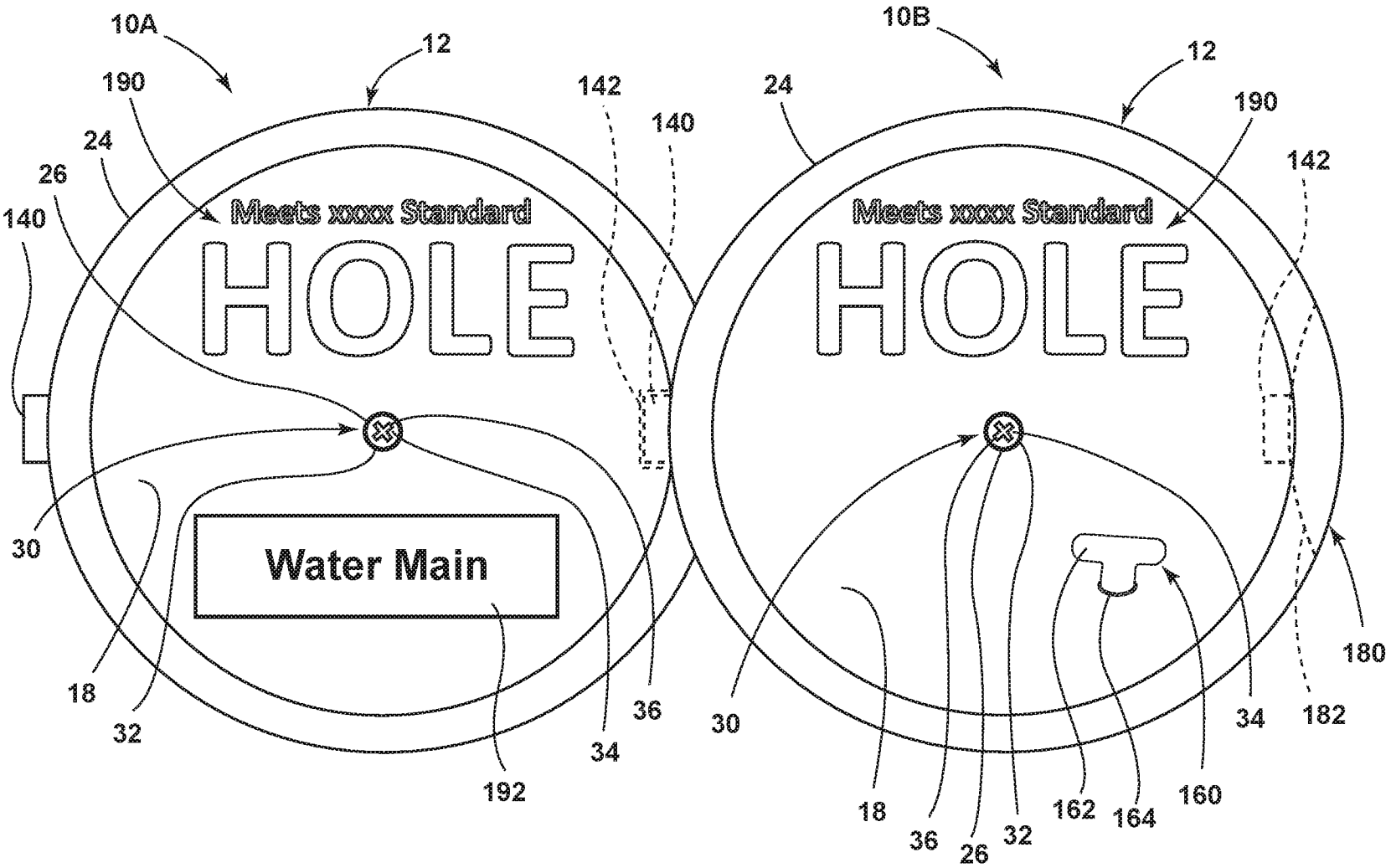
FIG. 17 is a top plan view of serially-aligned cover devices coupled to one another using interconnecting features.

Referring now to FIG. 16A, the tensioner member 110 is shown disengaged with gear 92B. Specifically, the tensioner member 110 is bent or otherwise moved to a disengaged position in FIG. 16A, and is retained in the disengaged position by a retaining post 160. With reference to FIG. 16B, the retaining post 160 has been removed, and the tensioner member 110 is free to move to the engaged position with gear 92B. Specifically, the tensioner member 110 is engaged with the toothed outer perimeter 98 of gear 92B. It is contemplated that the tensioner member 110 is biased towards the engaged position, such that the tensioner member 110 may be in a flexed condition in the disengaged position, and retained in this flexed condition by the retaining post 160. With reference to FIG. 17, the retaining post 160 includes a handle portion 162 that is accessible from the outer surface 18 of cover device 10B. The retaining post 160 is received through a receiving aperture 164 that is disposed through the cover plate 12. Thus, when loading the tensioner member 110, it is contemplated that the tensioner member will be moved to the disengaged position, and the retaining post 160 will be inserted through the receiving aperture 164 of the cover plate 12 to retain the tensioner member 110 in the disengaged position. When the retaining post 160 is removed from the receiving aperture 164, the tensioner member 110 is contemplated to move to the engaged position, as shown in FIG. 16B, to which the tensioner member 110 is biased. It is contemplated that a user will remove the retaining post 160 from the receiving aperture 164 by engaging the handle portion 162 from the outer surface 18 of the cover plate 12, and pulling the retaining post outwardly until the tensioner member 110 can clear a distal end of the retaining post 160.

Figure 16C:
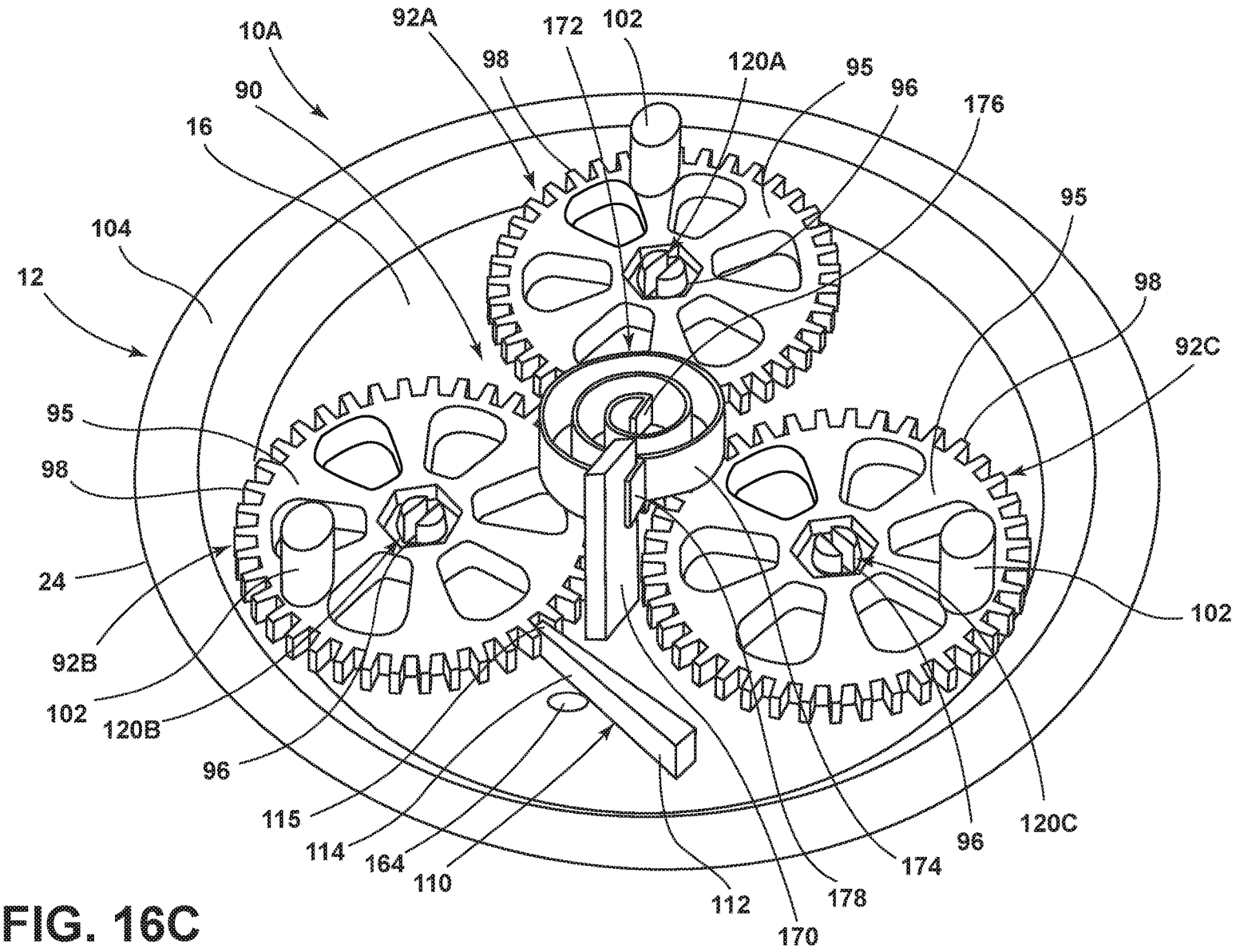
FIG. 16C is a bottom perspective view of the cover device of FIG. 16B showing the biasing member coupled to between the cover plate and the drive gear in an at-rest condition with the engagement members in a deployed position.

With further reference to FIG. 16A, a mounting member 170 is shown disposed on the inner surface 16 of the cover plate 12 and outwardly extending therefrom. A biasing member 172, shown in FIG. 16A in the form of a clock spring, is positioned in an exploded away position above the cover plate 12. The biasing member 172 includes a body portion 174 having first and second ends 176, 178. The first end 176 of the biasing member 172 is contemplated to connect to the retainer member 108 disposed on the drive gear 94. The second end 178 of the biasing member 172 is contemplated to connect to the mounting member 170 disposed on the inner surface 16 of the cover plate 12. The biasing member 172 is shown in the coupled position in FIG. 16B. In FIG. 16B, the biasing member 172 is also in a loaded condition. In the loaded condition, the biasing member 172 includes a rotational bias and is prepared to deliver a rotational force to the drive gear 94. However, in FIG. 16A, the biasing member 172 is retained in the loaded condition by the retainer member 108 of the drive gear 94. It is contemplated that a user will engage the fastener 32 of the adjustment mechanism 30 to release the biasing member 172. Once the biasing member 172 has been released from the loaded condition, the biasing member 172 is free to deliver a rotational force stored within the body portion 174 thereof to the drive gear 94 which further drives rotation of the gears 92A-92C of the multi-gear deployable retainer system 90 to move the engagement features 102 towards the outer perimeter 24 of the cover plate 12 for engagement with an interior perimeter surface of an aperture. In FIG. 16C, the biasing member 172 has been released from the loaded condition, and has rotated to an at-rest condition. During the rotation of the biasing member 172, the drive gear 94 has also rotated, as coupled thereto, and has driven rotation of the gears 92A-92C, such that the engagement features 102 of the gears 92A-92C are positioned for engagement with the structural features of an aperture. In this way, the cover device 10A of the present concept is capable of being available in pre-tensioned setting by the manufacturer, such that a user need only release the biasing member 172 to automatically employ the engagement features 102 of the multi-gear deployable retainer system 90.

Referring now to FIG. 17, cover devices 10A, 10B are shown having round cover plates 12 that are engaged with one another. In the engaged position, the interlocking tab 140 of cover device 10B is received in the inset recess 142 of cover device 10A which is shown in phantom on cover device 10A. Further, the cover plate 12 of cover device 10A is shown as having a removable portion removed, such that the cover plate 12 of cover device 10B can nest within the removed portion of cover plate 12 of cover device 10A. Cover device 10B also includes a removable portion 180 which can be moved along perforated line 182 to provide access to inset recess 142 of the cover device 10B. The perforated line 182 is contemplated to be visible to a user for directing a user to remove the removable portion 180 when interconnecting adjacent cover devices. It is contemplated that the removable portion 180 is rigidly coupled to the cover plate 12, such that a tool may be necessary to remove the removable portion 180. Removal of the removable portion 180 is guided by the perforated line 182. In this way, portions of the cover plate 12 can be removed to better engage serially-aligned cover devices (10A, 10B) when the cover plates 12 thereof are round shaped cover plates. Thus, the perforated line 182 is a perforated line provided through the cover plate 12 of cover device 10B, such that the removable portion 180 is a perforated break-away portion of the cover device 10B.

As further shown in FIG. 17, the outer surfaces 18 of the cover plates 12 of cover devices 10A and 10B may include indicia 190 that is molded into the outer surfaces thereof. This indicia 190 may include specifications or standards information to convey to a user that certain requirements are met when using the cover devices 10A, 10B to cover an aperture. Further, the cover device 10A may also include a smooth portion 192 that can be used by a user to write specific information on the outer surface 18 of the cover plate 12 to indicate the type of aperture being covered by cover device 10A. The smooth portion 192 may be a high contrast area as compared to the rest of the outer surface 18 of the cover plate 12 to draw attention to the smooth portion 192.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cover device, comprising:

a cover plate having inner and outer surfaces and an outer perimeter;

a deployable retainer mechanism positioned on the inner surface of the cover plate, the deployable retainer mechanism including a plurality of gears rotatably coupled to the inner surface of the cover plate;

engagement features outwardly extending from the plurality of gears, wherein each engagement feature is operable between retracted and deployed positions;

an adjustment mechanism accessible from the outer surface of the cover plate and having a drive gear rotatably coupled to the inner surface of the cover plate, wherein the drive gear interconnects the gears of the plurality of gears in a geared relationship, such that rotation of the drive gear provides for rotation of the gears of the plurality of gears, and further wherein the engagement features are rotated towards the drive gear when the engagement features are in the retracted position, and are rotated towards the outer perimeter of the cover plate when the engagement features are in the deployed position; and a tensioner member mounted on the inner surface of the cover plate and selectively moveable between engaged and disengaged positions with one or more gears of the plurality of gears, wherein the tensioner member restricts movement of the one or more gears of the plurality of gears when the tensioner member is in the engaged position.

2. The cover device of claim 1, including:

a sleeve member removeably received on one or more of the engagement features, wherein the sleeve member includes a flexibly resilient outer surface.

3. The cover device of claim 1, including:

a retaining post disposed slideably received through a receiving aperture of the cover plate, wherein the retaining post selectively engages and retains the tensioner member in the disengaged position.

4. The cover device of claim 1, including:

a biasing member having a first end operably coupled to the cover plate, a second end operably coupled to the drive gear, and a body portion disposed therebetween.

5. The cover device of claim 4, wherein the biasing member is operable between at-rest and loaded conditions, wherein the biasing member includes a rotational bias configured to drive the drive gear when the biasing member is in the loaded condition.

6. The cover device of claim 5, wherein the biasing mechanism is selectively retained in the loaded condition by the adjustment mechanism.

7. The cover device of claim 1, including:

an interlocking tab extending outwardly from the outer perimeter of the cover plate along a first side of the cover plate; and an inset recess disposed on a second side of the cover plate that is opposed to the first side of the cover plate.

8. The cover device of claim 7, including:

a removable portion of the cover plate that is coupled to the cover plate at a perforated line and disposed over the inset recess.

* * * * *